US011274866B2

(12) United States Patent
Yamada et al.

(10) Patent No.: US 11,274,866 B2
(45) Date of Patent: Mar. 15, 2022

(54) REFRIGERATION APPARATUS WITH A REFRIGERANT LEAKAGE DETECTION AND RELEASE MECHANISM

(71) Applicant: Daikin Industries, LTD., Osaka (JP)

(72) Inventors: Takuro Yamada, Osaka (JP); Masahiro Honda, Osaka (JP); Tetsuya Shirasaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 40 days.

(21) Appl. No.: 16/623,064

(22) PCT Filed: Aug. 3, 2018

(86) PCT No.: PCT/JP2018/029295
§ 371 (c)(1),
(2) Date: Dec. 16, 2019

(87) PCT Pub. No.: WO2019/027050
PCT Pub. Date: Feb. 7, 2019

(65) Prior Publication Data

US 2021/0148620 A1 May 20, 2021

(30) Foreign Application Priority Data

Aug. 3, 2017 (JP) ..... JP2017-150798

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/029* (2013.01); *F25B 2313/0233* (2013.01); *F25B 2500/222* (2013.01)

(58) Field of Classification Search
CPC ..... F25B 13/00; F25B 2313/0233; F25B 2313/029; F25B 49/02
See application file for complete search history.

(56) References Cited

U.S. PATENT DOCUMENTS

2019/0346165 A1* 11/2019 Obara ..... F24F 11/36
2019/0383511 A1* 12/2019 Tomita ..... F24F 11/38
(Continued)

FOREIGN PATENT DOCUMENTS

CN 204006307 U 12/2014
EP 1 584 506 A1 10/2005
(Continued)

*Primary Examiner* — Henry T Crenshaw
(74) *Attorney, Agent, or Firm* — Birch, Stewart, Kolasch & Birch, LLP

(57) ABSTRACT

An air conditioning system includes a refrigerant circuit including a use-side circuit, heat-source-side circuit and refrigerant release circuit, a refrigerant leakage detection unit in the use-side circuit, a heat-source-side control valve that enables, when in an opened state, the heat-source-side circuit to communicate with the refrigerant release circuit, a rupture disk that is disposed in the refrigerant release circuit and enables, when in a first state (an open state), the refrigerant release circuit to communicate with an external space to release refrigerant, and a controller. When no leakage of refrigerant in the use-side circuit is detected, the controller controls the heat-source-side control valve to a. closed state. When leakage of refrigerant, in the use-side circuit is detected by the refrigerant leakage detection unit, the controller switches the heat-source-side control valve to the opened state and causes the rupture disk to shift to the first state.

5 Claims, 6 Drawing Sheets

(56) References Cited

U.S. PATENT DOCUMENTS

| | | | | |
|---|---|---|---|---|
| 2019/0390876 | A1* | 12/2019 | Matsuda | F25B 49/02 |
| 2020/0049361 | A1* | 2/2020 | Minamida | F25B 49/02 |
| 2020/0363110 | A1* | 11/2020 | Suzuki | F25B 13/00 |

FOREIGN PATENT DOCUMENTS

| | | | |
|---|---|---|---|
| JP | 1-300170 | A | 12/1989 |
| JP | 5-118720 | A | 5/1993 |
| JP | 8-226572 | A | 9/1996 |
| JP | 2004-353578 | A | 12/2004 |
| JP | 2004353578 | * | 12/2004 |
| JP | 2005-233577 | A | 9/2005 |
| JP | 2010002137 | * | 1/2007 |
| JP | 2010-2137 | A | 1/2010 |

* cited by examiner

REFRIGERATION APPARATUS WITH A REFRIGERANT LEAKAGE DETECTION AND RELEASE MECHANISM

TECHNICAL FIELD

The present disclosure relates to a refrigeration apparatus.

BACKGROUND ART

Refrigeration apparatuses require provisions to ensure safety against possible leakage of refrigerant from a refrigerant circuit that may occur due to any damage to devices constituting the refrigerant circuit or due to improper installation of the devices. Specific provisions are particularly necessary for slightly flammable refrigerant such as R32 (not-so-flammable refrigerant but having characteristics of being flammable at a predetermined concentration or higher (at or above the lower flammable limit)).

For example, a method disclosed in PTL 1 (Japanese Unexamined Patent Application Publication No. 5-118720) as proposed provisions for leakage of refrigerant involves controlling, upon detection of leakage of refrigerant, a designated control valve (an electromagnetic valve, an electronic expansion valve, or any other valve whose opening degree is adjustable) in a refrigerant circuit to a closed state to interrupt refrigerant flowing into a use-side circuit and to eliminate or reduce the possibility that refrigerant will further leak into a use-side space in which the use-side circuit is installed (a living space, a garage space, or any other space people may enter).

SUMMARY OF THE INVENTION

Technical Problem

When being controlled to the closed state, control valves such as electromagnetic valves and electronic expansion valves are structurally incapable of completely interrupting a flow of refrigerant. In other words, the control valves may not be able to prevent refrigerant from leaking from one end side to the other end side. That is, minute refrigerant channels (microchannels) may be formed through such a control valve controlled to the closed state, and as a result, a very small amount of refrigerant may flow through the control valve.

Even if the control valve is controlled to the closed state at the time of occurrence of refrigerant leakage as disclosed in PTL 1, there is concern about the possibility that a very small amount of refrigerant flowing through the control valve may enter a use unit and leakage refrigerant will consequently build up in the use-side space. In a case where the use-side space is airtight or the refrigeration apparatus is left unused for a long period of time, there is particular concern about the possibility that the method disclosed in PTL 1 employed at the time of occurrence of refrigerant leakage in the use unit may cause the leakage refrigerant to become more concentrated on the use-side space. That is, in some cases, the method disclosed in PTL 1 may not be able to reliably ensure safety against leakage of refrigerant.

The present disclosure has therefore been made to provide added safety to a refrigeration apparatus.

Solution to Problem

A refrigeration apparatus according to a first aspect of the present disclosure includes a refrigerant circuit, a refrigerant leakage detection unit, a control valve, a refrigerant release mechanism, and a control unit. The refrigerant circuit includes a use-side circuit, a heat-source-side circuit, and a refrigerant release circuit. The heat-source-side circuit is connected to the use-side circuit. The refrigerant release circuit is connected to the heat-source-side circuit. The refrigerant leakage detection unit detects leakage of refrigerant in the use-side circuit. The control valve is disposed in the refrigerant release circuit or the heat-source-side circuit. When being in an opened state, the control valve enables the heat-source-side circuit to communicate with the refrigerant release circuit. The refrigerant release mechanism is disposed in the refrigerant release circuit. The refrigerant release mechanism enables, when being in a first state, the refrigerant release circuit to communicate with an external space outside the refrigerant circuit, such that refrigerant in the refrigerant release circuit is released into the external space. The control unit controls states of devices. When no leakage of refrigerant in the use-side circuit is detected by the refrigerant leakage detection unit, the control unit controls the control valve to a closed state. When leakage of refrigerant in the use-side circuit is detected by the refrigerant leakage detection unit, the control unit switches the control valve from the closed state to the opened state and directly or indirectly causes the refrigerant release mechanism to shift to the first state. The refrigerant release mechanism is a rupture disk. The rupture disk shifts to the first state when a pressure in the refrigerant release circuit becomes equal to or greater than a first threshold value. The term "first threshold value" herein refers to a set pressure at which the rupture disk ruptures. The term "first state" herein refers to a state in which the pressure in the refrigerant release circuit becomes equal to or greater than the first threshold value and the rupture disk ruptures accordingly.

When leakage of refrigerant in the use-side circuit is detected by the refrigerant leakage detection unit in the refrigeration apparatus according to the first aspect of the present disclosure, the control unit switches the control valve from the closed state to the opened state and causes the refrigerant release mechanism to shift to the first state. Thus, in the event of leakage of refrigerant in the use-side circuit, the control valve is opened to allow refrigerant to flow from the heat-source-side circuit to the refrigerant release circuit (the refrigerant release mechanism), and the refrigerant release mechanism shifts to the first state, in which refrigerant is released into the external space through the refrigerant release mechanism. This suppresses refrigerant flowing from the heat-source-side circuit to the use-side circuits and will eliminate or reduce the possibility of further leakage of refrigerant in the use-side circuits. This therefore eliminates or reduces the possibility that the amount of refrigerant leaking from the use-side circuit will reach a dangerously large value, such as the lower flammable limit or a value that would lead to an oxygen deficiency. In this way, added safety is provided in relation to refrigerant leakage.

Because the refrigerant release mechanism is a rupture disk that shifts to the first state when the pressure in the refrigerant release circuit becomes equal to or greater than the first threshold value, refrigerant may be released into the external space with ease and high accuracy at the time of occurrence of refrigerant leakage. Added safety may thus be provided with ease and high accuracy.

Herein, the refrigerant is not limited and may be a slightly flammable refrigerant such as R32.

The expression "directly or indirectly cause(s) the refrigerant release mechanism to shift to the first state" embraces not only the idea that the "control unit" directly controls the "refrigerant release mechanism" to the first state but also the idea that the "control unit" controls another device, such as the control valve, and the "refrigerant release mechanism", in turn, shifts to the first state (i.e., the idea of indirectly controlling the "refrigerant release mechanism" to the first state).

Herein, the type of the control valve is not limited as long as the valve is capable of switching between the opened state and the closed state, and may be, for example, an electronic expansion valve or an electromagnetic valve.

The term "refrigerant leakage detection unit" herein refers to a refrigerant leakage sensor that directly detects refrigerant leaking from the refrigerant circuit (leakage refrigerant), a pressure sensor or a temperature sensor that senses the state (pressure or temperature) of refrigerant in the refrigerant circuit, and/or a computer that determines, on the basis of detection values acquired from these sensors, whether leakage of refrigerant has occurred.

The term "closed state" herein refers to a minimum possible opening degree (including a "fully closed" state) of a valve (the state in which the flow of refrigerant is interrupted to the greatest extent possible), and the term "opened state" refers to any opening degree greater than the minimum opening degree.

A refrigeration apparatus according to a second aspect of the present disclosure is the refrigeration apparatus according to the first aspect further including a second control valve and a pressure regulating valve. The refrigerant release circuit includes a first channel and a second channel. One end of the first channel is connected to the heat-source-side circuit. The second channel is connected to the heat-source-side circuit independently of the first channel. When being in the opened state, the control valve allows refrigerant to flow from the heat-source-side circuit to the first channel. The second control valve is disposed on the second channel. When being in the opened state, the second control valve allows refrigerant to flow from the second channel to the heat-source-side circuit. The pressure regulating valve is disposed on the second channel between the second control valve and the heat-source-side circuit. When the pressure in the refrigerant release circuit becomes equal to or greater than a third threshold value, the pressure regulating valve releases the pressure in the refrigerant release circuit to the heat-source-side circuit. With this configuration, in a case when the pressure in the refrigerant release circuit rises with no occurrence of refrigerant leakage in the use-side circuit, refrigerant is conveyed from the refrigerant release circuit to the heat-source-side circuit via the pressure regulating valve, and the pressure may be reduced accordingly.

Herein, the type of the second control valve is not limited as long as the valve is capable of switching between the opened state and the closed state, and may be, for example, an electronic expansion valve or an electromagnetic valve.

Herein, the pressure regulating valve is not limited to a particular model or type and may be any valve capable of releasing the pressure in the refrigerant release circuit to the heat-source-side circuit when the pressure in the refrigerant release circuit becomes equal to or greater than the third threshold value.

A refrigeration apparatus according to a third aspect of the present disclosure is the refrigeration apparatus according to the second aspect, in which when no leakage of refrigerant in the use-side circuit is detected by the refrigerant leakage detection unit, the control unit controls the second control valve to the opened state. When leakage of refrigerant in the use-side circuit is detected by the refrigerant leakage detection unit, the control unit switches the second control valve from the opened state to the closed state. With this configuration, in a case when the pressure in the refrigerant release circuit rises with no occurrence of refrigerant leakage in the use-side circuit, refrigerant is conveyed from the refrigerant release circuit to the heat-source-side circuit via the pressure regulating valve. This provides added reliability in relation to liquid seal in the refrigerant release circuit and to malfunctions of the refrigerant release mechanism.

A refrigeration apparatus according to a fourth aspect of the present disclosure is the refrigeration apparatus according to any one of the first to third aspects further including a pressure reducing valve. The pressure reducing valve is disposed in the use-side circuit. The pressure reducing valve reduces the pressure of refrigerant in accordance with its opening degree. When leakage of refrigerant in the use-side circuit is detected by the refrigerant leakage detection unit, the control unit controls the pressure reducing valve to the closed state. This suppresses refrigerant flowing into the use-side circuit at the time of occurrence of refrigerant leakage in the use-side circuit and will eliminate or reduce the possibility of further leakage of refrigerant. In this way, further added safety is provided.

Herein, the type of the pressure reducing valve is not limited as long as the opening degree of the valve is adjustable and may be, for example, an electronic expansion valve. A refrigeration apparatus according to a fifth aspect of the present disclosure is the refrigeration apparatus according to any one of the first to fourth aspects further including a compressor, a channel-switching valve, a heat-source-side heat exchanger, a use-side heat exchanger, and a first valve. The compressor is disposed in the heat-source-side circuit. The compressor compresses refrigerant. The channel-switching valve redirects a flow of refrigerant between the heat-source-side circuit and the use-side circuit. The heat-source-side heat exchanger is disposed in the heat-source-side circuit. The heat-source-side heat exchanger functions as a refrigerant heat exchanger. The use-side heat exchanger is disposed in the use-side circuit. The use-side heat exchanger functions as a refrigerant heat exchanger. When being switched to the closed state, the first valve interrupts a flow of high-pressure refrigerant between the heat-source-side circuit and the use-side circuit. During normal cycle operation, the control unit controls the channel-switching valve to a normal cycle state to cause the heat-source-side heat exchanger to function as a refrigerant condenser or radiator and to cause the use-side heat exchanger to function as a refrigerant evaporator. During reverse cycle operation, the control unit controls the channel-switching valve to a reverse cycle state to cause the heat-source-side heat exchanger to function as a refrigerant evaporator and to cause the use-side heat exchanger to function as a refrigerant condenser or radiator. When leakage of refrigerant in the use-side circuit is detected by the refrigerant leakage detection unit, the control unit controls the channel-switching valve to the normal cycle state, controls the first valve to the closed state, and causes the compressor to operate.

In the event of leakage of refrigerant in the use-side circuit in the refrigeration apparatus according to the fifth aspect of the present disclosure, normal cycle operation is performed, with the first valve being in the closed state, such that refrigerant flowing from the heat-source-side circuit to the use-side circuit is further suppressed and recovery of refrigerant from the use-side circuit to the heat-source-side circuit is promoted. In this way, further added safety is provided.

Herein, the type of the first valve is not limited as long as the valve is capable of switching between the opened state and the closed state, and may be, for example, an electronic expansion valve or an electromagnetic valve.

DESCRIPTION OF EMBODIMENTS

An air conditioning system 100 (a refrigeration apparatus) according to an embodiment of the present disclosure will be described below with reference to the drawings. The following embodiment, which is provided as a specific example, should not be construed as limiting the technical scope and may be altered as appropriate within a range not departing from the spirit thereof.

The term "liquid refrigerant" hereinafter refers not only to liquid refrigerant in the saturated liquid state but also to gas-liquid two-phase refrigerant in the gas-liquid two-phase state. The term "closed state" herein refers to a minimum possible opening degree (including a "fully closed" state) of a valve, and the term "opened state" refers to any opening degree greater than the minimum opening degree.

(1) Air Conditioning System 100

Figure 1:
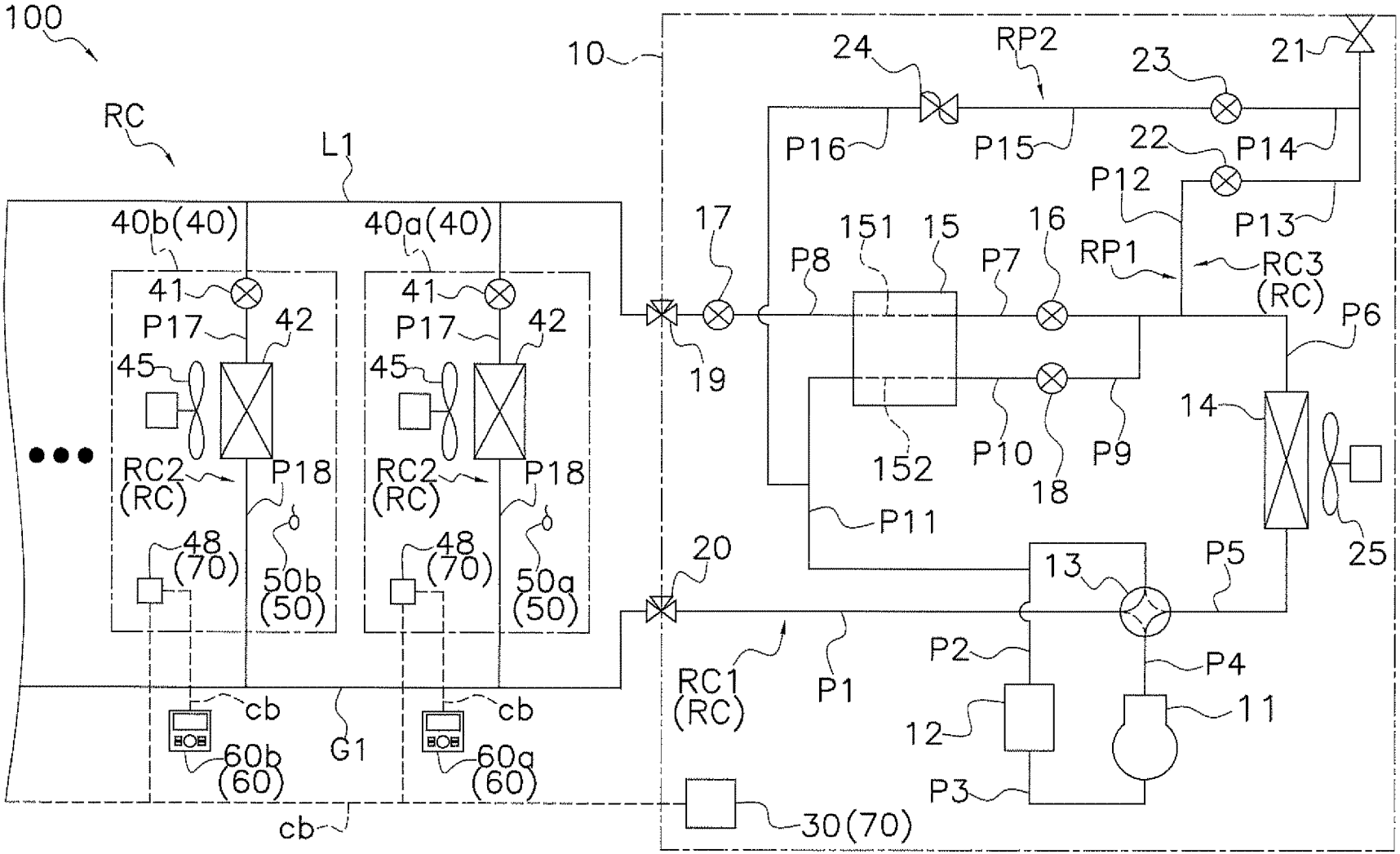
FIG. 1 is a schematic configuration diagram of an air conditioning system according to an embodiment of the present disclosure.

FIG. 1 is a schematic configuration diagram of the air conditioning system 100 according to an embodiment. The air conditioning system 100 is a system that employs a vapor compression refrigeration cycle to air-condition (cool or heat) a target space (a living space or space in a storage chamber, a low-temperature warehouse, or a shipping container). The air conditioning system 100 includes mainly a heat source unit 10, a plurality of use units 40 (40*a*, 40*b*, . . . ), a liquid-side connection pipe L1, a gas-side connection pipe G1, a plurality of refrigerant leakage sensors 50 (50*a*, 50*b*, . . . ), a plurality of remote controllers 60 (60*a*, 60*b*, . . . ), and a controller 70 that controls operation of the air conditioning system 100.

In the air conditioning system 100, the heat source unit 10 and the use units 40 are connected to each other via the liquid-side connection pipe L1 and the gas-side connection pipe G1 to constitute a refrigerant circuit RC. The air conditioning system 100 performs a refrigeration cycle in which refrigerant in the refrigerant circuit RC undergoes: compression; cooling or condensation; pressure reduction; heating or evaporation; and subsequent compression. In the present embodiment, slightly flammable R32 is charged into the refrigerant circuit RC to serve as refrigerant for the vapor compression refrigeration cycle. The refrigerant circuit RC includes a heat-source-side circuit RC1, use-side circuits RC2, and a refrigerant release circuit RC3.

(1-1) Heat Source Unit 10

The heat source unit 10 is disposed outdoors. The heat source unit 10 is connected to the use units 40 via the liquid-side connection pipe L1 and the gas-side connection pipe G1 and is configured as part of the refrigerant circuit RC (the heat-source-side circuit RC1 and the refrigerant release circuit RC3).

The heat source unit 10 includes mainly, as devices constituting the heat-source-side circuit RC1, a plurality of refrigerant pipes (a first pipe P1 to an eleventh pipe P11), a compressor 11, an accumulator 12, a four-way switching valve 13, a heat-source-side heat exchanger 14, a subcooler 15, a heat-source-side first control valve 16, a heat-source-side second control valve 17, a heat-source-side third control valve 18, a liquid-side shutoff valve 19, and a gas-side shutoff valve 20.

The first pipe P1 forms a connection between the gas-side shutoff valve 20 and a first port of the four-way switching valve 13. The second pipe P2 forms a connection between an inlet port of the accumulator 12 and a second port of the four-way switching valve 13. The third pipe P3 forms a connection between an outlet port of the accumulator 12 and an intake port of the compressor 11. The fourth pipe P4 forms a connection between a discharge port of the compressor 11 and a third port of the four-way switching valve 13. The fifth pipe P5 forms a connection between a fourth port of the four-way switching valve 13 and a gas-side inlet/outlet port of the heat-source-side heat exchanger 14. The sixth pipe P6 forms a connection between a liquid-side inlet/outlet port of the heat-source-side heat exchanger 14 and one end of the heat-source-side first control valve 16. The seventh pipe P7 forms a connection between the other end of the heat-source-side first control valve 16 and one end of a main channel 151 in the subcooler 15. The eighth pipe P8 forms a connection between the other end of the main channel 151 in the subcooler 15 and one end of the liquid-side shutoff valve 19. The ninth pipe P9 forms a connection between one end of the heat-source-side third control valve 18 and a portion of the sixth pipe P6 between its two ends. The tenth pipe P10 forms a connection between the other end of the heat-source-side third control valve 18 and one end of a subchannel 152 in the subcooler 15. The eleventh pipe P11 forms a connection between the other end of the subchannel 152 in the subcooler 15 and a portion of the second pipe P2 between its two ends. Each of these refrigerant pipes (the pipes P1 to P11) may be practically constructed of a single pipe or a plurality of pipes connected to each other via a joint and the like.

The compressor 11 is a device that compresses refrigerant at a low pressure in the refrigeration cycle to a high pressure. In the present embodiment, the compressor 11 has a closed structure in which a rotary-type or scroll-type positive-displacement compression element is driven and rotated by a compressor motor (not illustrated). The operating frequency of the compressor motor may be controlled by an inverter, and the capacity of the compressor 11 is controllable accordingly.

The accumulator 12 is a container provided to eliminate or reduce the possibility that an excessive amount of liquid refrigerant will be sucked into the compressor 11. The accumulator 12 has a predetermined volumetric capacity according to an amount of the refrigerant charged in the refrigerant circuit RC.

The four-way switching valve 13 is a channel-switching valve for redirecting a flow of refrigerant in the refrigerant circuit RC. The four-way switching valve 13 enables switching between the normal cycle state and the reverse cycle state. When the four-way switching valve 13 is switched to the normal cycle state, the first port (the first pipe P1) communicates with the second port (the second pipe P2) and the third port (the fourth pipe P4) communicates with the fourth port (the fifth pipe P5) (see solid lines in the four-way switching valve 13 illustrated in FIG. 1). When the four-way switching valve 13 is switched to the reverse cycle state, the first port (the first pipe P1) communicates with the third port (the forth pipe P4) and the second port (the second pipe P2) communicates with the fourth port (the fifth pipe P5) (see broken lines in the four-way switching valve 13 illustrated in FIG. 1).

The heat-source-side heat exchanger 14 is a heat exchanger that functions as a refrigerant condenser (or radiator) or a refrigerant evaporator. The heat-source-side heat exchanger 14 functions as a refrigerant condenser during normal cycle operation (operation in which the four-way switching valve 13 is in the normal cycle state). The heat-source-side heat exchanger 14 functions as a refrigerant evaporator during reverse cycle operation (operation in which the four-way switching valve 13 is in the reverse cycle state). The heat-source-side heat exchanger 14 includes a plurality of heat transfer tubes and a heat transfer fin (not illustrated). The heat-source-side heat exchanger 14 is configured to enable exchange of heat between refrigerant in the heat transfer tubes and air flowing around the heat transfer tubes or around the heat transfer fin (heat-source-side air flow, which will be described later).

The subcooler 15 is a heat exchanger that brings incoming refrigerant into liquid refrigerant in a subcooled state. The subcooler 15 is, for example, a double-tube heat exchanger, and the main channel 151 and the subchannel 152 are formed in the subcooler 15. The subcooler 15 is configured to enable heat exchange between refrigerant flowing through the main channel 151 and refrigerant flowing through the sub channel 152.

The heat-source-side first control valve 16 is an electronic expansion valve whose opening degree is controllable, such that the pressure of incoming refrigerant may be reduced in accordance with the opening degree or the flow rate of incoming refrigerant may be regulated in accordance with the opening degree. The heat-source-side first control valve 16 is capable of switching between the opened state and the closed state. The heat-source-side first control valve 16 is disposed between the heat-source-side heat exchanger 14 and the subcooler 15 (the main channel 151).

The heat-source-side second control valve 17 (corresponding to the "first valve" in the appended claims) is an electronic expansion valve whose opening degree is controllable, such that the pressure of incoming refrigerant may be reduced in accordance with the opening degree or the flow rate of incoming refrigerant may be regulated in accordance with the opening degree. The heat-source-side second control valve 17 is capable of switching between the opened state and the closed state. The heat-source-side second control valve 17 is disposed on the eighth pipe P8 between the subcooler 15 (the main channel 151) and the liquid-side shutoff valve 19. When being controlled to the closed state, the heat-source-side second control valve 17 interrupts a flow of refrigerant between the heat-source-side circuit RC1 and each of the use-side circuits RC2. The opening degree of the heat-source-side second control valve 17 may be controlled so that refrigerant conveyed from the heat source unit 10 to the liquid-side connection pipe L1 is brought into refrigerant in the gas-liquid two-phase state. The amount of refrigerant charged into the refrigerant circuit RC may be reduced accordingly.

The heat-source-side third control valve 18 is an electronic expansion valve whose opening degree is controllable, such that the pressure of incoming refrigerant may be reduced in accordance with the opening degree or the flow rate of incoming refrigerant may be regulated in accordance with the opening degree. The heat-source-side third control valve 18 is capable of switching between the opened state and the closed state. The heat-source-side third control valve 18 is disposed between the heat-source-side heat exchanger 14 and the subcooler 15 (the subchannel 152).

The liquid-side shutoff valve 19 is a manual valve disposed in the portion where the eighth pipe P8 is connected to the liquid-side connection pipe L1. One end of the liquid-side shutoff valve 19 is connected to the eighth pipe P8 and the other end of the liquid-side shutoff valve 19 is connected to the liquid-side connection pipe L1.

The gas-side shutoff valve 20 is a manual valve disposed in the portion where the first pipe P1 is connected to the gas-side connection pipe G1. One end of the gas-side shutoff valve 20 is connected to the first pipe P1 and the other end of the gas-side shutoff valve 20 is connected to the gas-side connection pipe G1.

The heat source unit 10 includes mainly, as devices constituting of the refrigerant release circuit RC3, a plurality of refrigerant pipes (a twelfth pipe P12 to a sixteenth pipe P16), a refrigerant release mechanism 21, a heat-source-side fourth control valve 22, a heat-source-side fifth control valve 23, and a pressure regulating valve 24.

The twelfth pipe P12 forms a connection between one end of the heat-source-side fourth control valve 22 and a portion of the sixth pipe P6 between its two ends. The thirteenth pipe P13 forms a connection between the other end of the heat-source-side fourth control valve 22 and the refrigerant release mechanism 21. The fourteenth pipe P14 forms a connection between one end of the heat-source-side fifth control valve 23 and a portion of the thirteenth pipe P13 between its two ends. The fifteenth pipe P15 forms a connection between the other end of the heat-source-side fifth control valve 23 and one end of the pressure regulating valve 24. The sixteenth pipe P16 forms a connection between the other end of the pressure regulating valve 24 and a portion of the eleventh pipe P11 between its two ends. Each of these refrigerant pipes (the pipes P12 to P16) may be practically constructed of a single pipe or a plurality of pipes connected to each other via a joint and the like.

When the refrigerant release mechanism 21 is in an open state (corresponding to the "first state" in the appended claims), the refrigerant release circuit RC3 communicates with the external space, such that refrigerant in the refrigerant release circuit RC3 is released into the external space. The refrigerant release mechanism 21 is disposed in an end portion of the refrigerant release circuit RC3 opposite to another end portion thereof closer to the heat-source-side circuit RC1. More specifically, the refrigerant release mechanism 21 is disposed on a first channel RP1, which will be described later. In the present embodiment, the refrigerant release mechanism 21 is a rupture disk that bursts open when receiving, from refrigerant flowing in from an inlet-side port, a pressure of a first threshold value $\Delta Th1$ or greater. That is, the rupture disk shifts to the open state when the pressure of refrigerant in the refrigerant release circuit RC3 becomes equal to or greater than the first threshold value $\Delta Th1$. The rupture disk to be used may be a well-known rupture disk that bursts open through, for example, buckling and inversion at the tensile strength limit or the buckling strength limit of the material. The refrigerant release mechanism 21 is connected to the thirteenth pipe P13 by a predetermined connecting means such as flange connection or brazing connection. The first threshold value $\Delta Th1$ may be adjusted as appropriate in accordance with design specifications or installation environments. In the present embodiment, the first threshold value ΔTh1 may be any value smaller than the discharge pressure in the compressor 11. The first threshold value ΔTh1 is set to, for example, 3.8 MPa but is not necessarily limited to this value.

The heat-source-side fourth control valve 22 (corresponding to the "control valve" in the appended claims) is an electronic expansion valve whose opening degree is controllable, such that the pressure of incoming refrigerant may be reduced in accordance with the opening degree or the flow rate of incoming refrigerant may be regulated in accordance with the opening degree. The heat-source-side fourth control valve 22 is capable of switching between the opened state and the closed state. The heat-source-side fourth control valve 22 is disposed in the refrigerant release circuit RC3 between the refrigerant release mechanism 21 and the heat-source-side circuit RC1. More specifically, the heat-source-side fourth control valve 22 is disposed on the first channel RP1, which will be described later. When the heat-source-side fourth control valve 22 is in the opened state, the heat-source-side circuit RC1 communicates with the refrigerant release circuit RC3 (the first channel RP1, which will be described later), such that refrigerant is allowed to flow from the heat-source-side circuit RC1 to the refrigerant release circuit RC3 (the first channel RP1, which will be described later). When being in the closed state, the heat-source-side fourth control valve 22 interrupts refrigerant flowing from the heat-source-side circuit RC1 to the refrigerant release circuit RC3 (the first channel RP1, which will be described later).

The heat-source-side fifth control valve 23 (corresponding to the "second control valve" in the appended claims) is an electronic expansion valve whose opening degree is controllable, such that the pressure of incoming refrigerant may be reduced in accordance with the opening degree or the flow rate of incoming refrigerant may be regulated in accordance with the opening degree. The heat-source-side fifth control valve 23 is capable of switching between the opened state and the closed state. The heat-source-side fifth control valve 23 is disposed in the refrigerant release circuit RC3 between the refrigerant release mechanism 21 and the pressure regulating valve 24, or more specifically, is disposed on a second channel RP2, which will be described later. When the heat-source-side fifth control valve 23 is in the opened state, the heat-source-side circuit RC1 communicates with the refrigerant release circuit RC3 (the second channel RP2, which will be described later), such that refrigerant is allowed to flow from the refrigerant release circuit RC3 (the second channel RP2, which will be described later) to the heat-source-side circuit RC1. When being in the closed state, the heat-source-side fifth control valve 23 interrupts refrigerant flowing from the refrigerant release circuit RC3 (the second channel RP2, which will be described later) to the heat-source-side circuit RC1.

The pressure regulating valve 24 is disposed in the refrigerant release circuit RC3 between the heat-source-side fifth control valve 23 and the heat-source-side circuit RC1. More specifically, the pressure regulating valve 24 is disposed on the second channel RP2, which will be described later. Under normal conditions, the pressure regulating valve 24 interrupts refrigerant flowing from one end side to the other end side. When the pressure of the refrigerant on the one end side reaches or exceeds a set value (a third threshold value ΔTh3 determined in accordance with installation environments or design specifications and being smaller than the first threshold value ΔTh1), the pressure regulating valve 24 allows refrigerant to flow to the other end side to eliminate or reduce the possibility that the pressure of refrigerant in the circuit communicating with the one end side will increase excessively. That is, when the pressure in the refrigerant release circuit RC3 becomes equal to or greater than the third threshold value ΔTh3, the pressure regulating valve 24 releases the pressure in the refrigerant release circuit RC3 to the heat-source-side circuit RC1. The pressure regulating valve 24 to be used may be a well-known pressure regulating valve, which may be of a type that includes an elastic body to adjust the valve element position. The third threshold value ΔTh3 may be adjusted as appropriate in accordance with design specifications or installation environments.

The heat source unit 10 also includes a heat-source-side fan 25, which generates heat-source-side air flow flowing through the heat-source-side heat exchanger 14. The heat-source-side fan 25 is a fan that supplies the heat-source-side heat exchanger 14 with the heat-source-side air flow, which is a cooling source or a heating source for refrigerant flowing through the heat-source-side heat exchanger 14. The heat-source-side fan 25 includes, as a drive source, a heat-source-side fan motor (not illustrated), and start/stop and revolution frequency thereof are controlled depending on the circumstance.

In addition, the heat source unit 10 incorporates heat-source-side sensors 26 (see FIG. 2) to sense the state (the pressure or temperature in particular) of refrigerant in the refrigerant circuit RC. Each heat-source-side sensor 26 is a pressure sensor or a temperature sensor such as a thermistor or a thermocouple. For example, the heat-source-side sensors 26 include sensors such as: a suction pressure sensor that senses suction pressure, which is the pressure of refrigerant on the intake side of the compressor 11; a discharge pressure sensor that senses discharge pressure, which is the pressure of refrigerant on the discharge side of the compressor 11; a temperature sensor that senses the temperature of refrigerant in the heat-source-side heat exchanger 14; and a pressure sensor that senses the pressure of refrigerant in the refrigerant release circuit RC3.

The heat source unit 10 also incorporates a heat-source-unit control unit 30, which controls the operation and states of the devices included in the heat source unit 10. The heat-source-unit control unit 30 includes a microcomputer incorporating, for example, a CPU and a memory. The heat-source-unit control unit 30 is electrically connected to the devices (11, 13, 16, 17, 18, 22, 23, 25, etc.) and the heat-source-side sensors 26 included in the heat source unit 10 to perform signal input and output. The heat-source-unit control unit 30 transmits and receives, for example, control signals to and from use-unit control units 48 (which will be described later) of the use units 40 and the remote controllers 60 through a communication line cb on an individual basis.

(1-2) Use Units 40

Each use unit 40 is connected to the heat source unit 10 via the liquid-side connection pipe L1 and the gas-side connection pipe G1. The use units 40 are connected in parallel or series to each other with respect to the heat source unit 10. The use units 40 are disposed in the target space and are configured as part of the refrigerant circuit RC (the use-side circuits RC2). Each use unit 40 includes mainly, as devices constituting the corresponding use-side circuit RC2, a plurality of refrigerant pipes (a seventeenth pipe P17 and an eighteenth pipe P18), a use-side expansion valve 41, and a use-side heat exchanger 42.

The seventeenth pipe P17 forms a connection between the liquid-side connection pipe L1 and a liquid-side refrigerant inlet/outlet port of the use-side heat exchanger 42. The eighteenth pipe P18 forms a connection between a gas-side refrigerant inlet/outlet port of the use-side heat exchanger 42 and the gas-side connection pipe G1. Each of these refrigerant pipes (the pipes P17 and P18) may be practically constructed of a single pipe or a plurality of pipes connected to each other via a joint and the like.

The use-side expansion valve 41 (corresponding to the "pressure reducing valve" in the appended claims) is an electronic expansion valve whose opening degree is controllable, such that the pressure of incoming refrigerant may be reduced in accordance with the opening degree or the flow rate of incoming refrigerant may be regulated in accordance with the opening degree. The use-side expansion valve 41 is capable of switching between the opened state and the closed state. The use-side expansion valve 41 is disposed on the seventeenth pipe P17 and is located between the liquid-side connection pipe L1 and the use-side heat exchanger 42.

The use-side heat exchanger 42 is a heat exchanger that functions as a refrigerant evaporator or a refrigerant condenser (or radiator). The use-side heat exchanger 42 functions as a refrigerant evaporator during normal cycle operation. The use-side heat exchanger 42 functions as a refrigerant condenser during reverse cycle operation. The use-side heat exchanger 42 includes a plurality of heat transfer tubes and a heat transfer fin (not illustrated). The use-side heat exchanger 42 is configured to enable exchange of heat between refrigerant in the heat transfer tubes and air flowing around the heat transfer tubes or around the heat transfer fin (use-side air flow, which will be described later). Each use unit 40 includes a use-side fan 45, which takes in air from the target space, sends the air through the use-side heat exchanger 42, in which the air exchanges heat with refrigerant, and blows the air back into the target space. The use-side fan 45 is disposed in the target space. The use-side fan 45 includes a use-side fan motor (not illustrated) as a drive source. When being driven, the use-side fan 45 generates use-side air flow, which is a cooling source or a heating source for the refrigerant flowing through the use-side heat exchanger 42.

In addition, each use unit 40 incorporates a use-side sensor 46 (see FIG. 2) to sense the state (the pressure or temperature in particular) of refrigerant in the refrigerant circuit RC. Each use-side sensor 46 is a pressure sensor or a temperature sensor such as a thermistor or a thermocouple. For example, the use-side sensors 46 include sensors such as a temperature sensor that senses the temperature of refrigerant in the use-side heat exchanger 42 and a pressure sensor that senses the pressure of refrigerant in the use-side circuit RC2.

Each use unit 40 also incorporates a use-unit control unit 48, which controls the operation and states of the devices included in the use unit 40. The use-unit control unit 48 includes a microcomputer incorporating, for example, a CPU and a memory. The use-unit control unit 48 is electrically connected to the devices (41, 45) and the use-side sensor 46 included in the use unit 40 to mutually perform signal input and output. The use-unit control unit 48 is connected to heat-source-unit control unit 30 and the remote controller 60 through the communication line cb to transmit and receive, for example, control signals.

(1-3) Liquid-Side Connection Pipe L1 and Gas-Side Connection Pipe G1

The liquid-side connection pipe L1 and the gas-side connection pipe G1 are connection pipes that form connections between the heat source unit 10 and the use units 40 and are installed on-site. The pipe lengths and pipe diameters of the liquid-side connection pipe L1 and the gas-side connection pipe G1 are selected as appropriate in accordance with design specifications or installation environments. Each of the liquid-side connection pipe L1 and the gas-side connection pipe G1 may be practically constructed of a single pipe or a plurality of pipes connected to each other via a joint and the like.

(1-4) Refrigerant Leakage Sensor 50

Each refrigerant leakage sensor 50 is a sensor for sensing leakage of refrigerant in the target space in which the use unit 40 is installed, or more specifically, leakage of refrigerant in the use unit 40. In the present embodiment, each refrigerant leakage sensor 50 is a well-known general-purpose product suited to the type of refrigerant sealed in the refrigerant circuit RC. The refrigerant leakage sensors 50 are disposed in the target space. More specifically, the refrigerant leakage sensors 50 are in a one-to-one correspondence with the use units 40 and are disposed in the respective use units 40.

Each refrigerant leakage sensor 50 continuously or intermittently outputs, to the controller 70, electrical signals (refrigerant-leakage-sensor detection signals) corresponding to detection values. More specifically, the refrigerant-leakage-sensor detection signals output by the refrigerant leakage sensor 50 vary in voltage depending on the concentration of refrigerant sensed by the refrigerant leakage sensor 50. In other words, the refrigerant-leakage-sensor detection signals are output to the controller 70 in a manner so as to enable not only a determination on whether leakage of refrigerant has occurred in the refrigerant circuit RC but also a determination of the concentration of leakage refrigerant in the target space in which the refrigerant leakage sensor 50 is installed, or more specifically, the concentration of refrigerant detected by the refrigerant leakage sensor 50. The refrigerant leakage sensor 50 is thus regarded as a "refrigerant leakage detection unit" that detects refrigerant leakage in the use-side circuit RC2, or more specifically, the concentration of the refrigerant, through direct detection of refrigerant flowing out from the use-side circuit RC2.

(1-5) Remote Controller 60

Each remote controller 60 is an input device that enables the user to input various commands for switching between operation states of the air conditioning system 100. For example, the remote controller 60 receives, from the user, input of a command to perform on-off switching of the use unit 40 or to change the set temperature of the use unit 40.

In addition, the remote controller 60 functions as a display device for presenting various pieces of information to the user. For example, the remote controller 60 displays the operation state, such as the set temperature, of the use unit 40. In the event of leakage of refrigerant, the remote controller 60 displays, for example, information for alerting the manager to the occurrence of refrigerant leakage and indicating actions to be taken (hereinafter referred to as "refrigerant leakage alert information").

The remote controller 60 is connected to the controller 70, or more specifically, to the use-unit control unit 48 through the communication line cb to transmit and receive signals each other. The remote controller 60 transmits, to the controller 70 through the communication line cb, commands input by the user. The remote controller 60 displays information in accordance with instructions received through the communication line cb.

(1-6) Controller 70

The controller 70 (corresponding to the "control unit" in the appended claims) is a computer that controls the states of the individual devices to control the operation of the air conditioning system 100. In the present embodiment, the controller 70 is configured by connecting the heat-source-unit control unit 30 and the use-unit control units 48 in the respective use units 40 through the communication line cb. The controller 70 will be described in detail in the section "(4) Details of Controller 70".

(2) Heat-Source-Side Circuit RC1, Use-Side Circuits RC2, and Refrigerant Release Circuit RC3

The refrigerant circuit RC includes the heat-source-side circuit RC1, the use-side circuits RC2 connected to the heat-source-side circuit RC1, and the refrigerant release circuit RC3 connected to the heat-source-side circuit RC1. Under normal conditions with no occurrence of refrigerant leakage, refrigerant circulates between the heat-source-side circuit RC1 and the use-side circuit RC2 in the use units 40 in operation. That is, during operation, a refrigeration cycle is usually performed in the heat-source-side circuit RC1 and the use-side circuits RC2.

The refrigerant release circuit RC3 is a circuit for ensuring safety against possible leakage of refrigerant and includes mainly the first channel RP1 and the second channel RP2. The first channel RP1 and the second channel RP2 independently communicate with the heat-source-side circuit RC1.

The first channel RP1 is the refrigerant channel including mainly the twelfth pipe P12, the heat-source-side fourth control valve 22, the thirteenth pipe P13, and the refrigerant release mechanism 21. One end of the first channel RP1 is connected to the heat-source-side circuit RC1 (the sixth pipe P6). When the heat-source-side fourth control valve 22 is in the closed state, the first channel RP1 is not opened and refrigerant flowing from the heat-source-side circuit RC1 is interrupted accordingly. When the heat-source-side fourth control valve 22 is in the opened state, the first channel RP1 is opened and refrigerant, in turn, flows from the heat-source-side circuit RC1 into the first channel RP1.

The second channel RP2 is the refrigerant channel including mainly the fourteenth pipe P14, the heat-source-side fifth control valve 23, the fifteenth pipe P15, the pressure regulating valve 24, and the sixteenth pipe P16. One end of the second channel RP2 is connected to the heat-source-side circuit RC1 (the eleventh pipe P11) independently of the first channel RP1, and the other end of the second channel RP2 is connected to the first channel RP1 (the thirteenth pipe P13). When the heat-source-side fifth control valve 23 is in the closed state, the second channel RP2 is not opened and refrigerant flowing from the first channel RP1 is interrupted accordingly. When the heat-source-side fifth control valve 23 is in the opened state, the second channel RP2 is opened and refrigerant, in turn, flows to and fro between the refrigerant release circuit RC3 and the heat-source-side circuit RC1.

(3) Flow of Refrigerant in Refrigerant Circuit RC

The following describes the flow of refrigerant in the refrigerant circuit RC. The air conditioning system 100 mainly performs normal cycle operation and reverse cycle operation. Low pressure in the refrigeration cycle refers to the pressure of the refrigerant sucked into the compressor 11 (suction pressure), and high pressure in the refrigeration cycle refers to the pressure of the refrigerant discharged from the compressor 11 (discharge pressure).

When no leakage of refrigerant is detected by the refrigerant leakage sensors 50, the heat-source-side fourth control valve 22 is controlled to the closed state, and the first channel RP1 in the refrigerant release circuit RC3 is not opened. Further, when no leakage of refrigerant is detected by the refrigerant leakage sensors 50, the heat-source-side fifth control valve 23 is in the opened state and the second channel RP2 is opened accordingly, and thus, when the pressure in the refrigerant release circuit RC3 becomes equal to or greater than the third threshold value ΔTh3, the pressure regulating valve 24 is activated to convey refrigerant in the second channel RP2 toward the heat-source-side circuit RC1. This eliminates or reduces the possibility that when there is no leakage of refrigerant, the pressure of refrigerant in the refrigerant release circuit RC3 will become equal to or greater than the first threshold value ΔTh1 and that the refrigerant release mechanism 21 will thus be activated (shift to the open state) erroneously.

(3-1) Flow of Refrigerant During Normal Cycle Operation

During normal cycle operation, the four-way switching valve 13 is controlled to the normal cycle state, and the refrigerant charged into the refrigerant circuit RC circulates mainly through the following devices in the order of the compressor 11, the heat-source-side heat exchanger 14, the heat-source-side first control unit 16, the subcooler 15, the heat-source-side second control valve 17, the use units 40 (the use-side expansion valve 41 and the use-side heat exchanger 42) in operation, and then the compressor 11. In normal cycle operation, part of the refrigerant flowing though the sixth pipe P6 branches to the ninth pipe P9, flows through the heat-source-side third control valve 18 and the subcooler 15 (the subchannel 152), and then returns to the compressor 11.

Specifically, when normal cycle operation is started, refrigerant in the heat-source-side circuit RC1 is sucked into the compressor 11, is compressed, and is then discharged. The capacity of the compressor 11 is controlled in accordance with the heat load required in the use units 40 in operation. Specifically, a target value of the suction pressure is specified in accordance with the heat load required in the use units 40, and the operating frequency of the compressor 11 is controlled to set the suction pressure to the target value. Gas refrigerant discharged from the compressor 11 flows into the heat-source-side heat exchanger 14.

After flowing into the heat-source-side heat exchanger 14, the gas refrigerant in the heat-source-side heat exchanger 14 radiates heat by exchanging heat with heat-source-side air flow sent by the heat-source-side fan 25 and is thus condensed. After flowing out from the heat-source-side heat exchanger 14, the refrigerant is split as it flows through the sixth pipe P6.

A part of the refrigerant branching from the sixth pipe P6 flows into the heat-source-side first control valve 16, in which the pressure of the refrigerant is reduced in accordance with the opening degree of the heat-source-side first control valve 16 or the flow rate of the refrigerant is regulated in accordance with the opening degree of the heat-source-side first control valve 16, and then flows into the main channel 151 in the subcooler 15. After flowing into the main channel 151 in the subcooler 15, the refrigerant exchanges heat with the refrigerant flowing through the subchannel 152 to be further cooled into liquid refrigerant in the subcooled state. Then, the pressure of the refrigerant flowing out from the main channel 151 in the subcooler 15 is reduced in accordance with the opening degree of the heat-source-side second control valve 17 or the flow rate of the refrigerant is regulated in accordance with the opening degree of the heat-source-side second control valve 17. The resultant refrigerant is in the gas-liquid two-phase state. The refrigerant then flows out from the heat-source-side circuit RC1 and flows through the liquid-side connection pipe L1 to enter the use-side circuit RC2 in the use units 40 in operation.

The rest of the refrigerant branching from the sixth pipe P6 flows into the heat-source-side third control valve 18, in which the pressure of the refrigerant is reduced in accordance with the opening degree of the heat-source-side third control valve 18 or the flow rate of the refrigerant is regulated in accordance with the opening degree of the heat-source-side third control valve 18, and then flows into the subchannel 152 in the subcooler 15. After flowing into the subchannel 152 in the subcooler 15, the refrigerant exchanges heat with the refrigerant flowing through the main channel 151 and flows through the eleventh pipe P11 to merge with the refrigerant flowing through the second pipe P2.

After flowing into the use-side circuit RC2 in the use unit 40 in operation, the refrigerant flows into the use-side expansion valve 41, in which the pressure of the refrigerant is reduced to the low pressure in the refrigerant cycle in accordance with the opening degree of the use-side expansion valve 41, and then flows into the use-side heat exchanger 42.

After flowing into the use-side heat exchanger 42, the refrigerant evaporates by exchanging heat with use-side air flow sent by the use-side fan 45, and the resultant gas refrigerant then flows out from the use-side heat exchanger 42. After flowing out from the use-side heat exchanger 42, the gas refrigerant flows out from the use-side circuit RC2.

After flowing out from the use-side circuit RC2, the refrigerant flows through the gas-side connection pipe G1 to enter the heat source unit 10. After flowing into the heat source unit 10, the refrigerant flows through the first pipe P1, the four-way switching valve 13, and the second pipe P2 to enter the accumulator 12. After entering the accumulator 12, the refrigerant is temporarily stored and is then sucked back into the compressor 11.

(3-2) Flow of Refrigerant During Reverse Cycle Operation

During reverse cycle operation, the four-way switching valve 13 is controlled to the reverse cycle state, and the refrigerant charged into the refrigerant circuit RC circulates mainly through the following devices in the order of the compressor 11, the use units 40 (the use-side heat exchanger 42 and the use-side expansion valve 41) in operation, the heat-source-side second control valve 17, the subcooler 15, the heat-source-side first control valve 16, the heat-source-side heat exchanger 14, and then the compressor 11.

Specifically, when reverse cycle operation is started, refrigerant in the heat-source-side circuit RC1 is sucked into the compressor 11, is compressed, and is then discharged. The capacity of the compressor 11 is controlled in accordance with the heat load required in the use units 40 in operation. After being discharged from the compressor 11, the gas refrigerant flows through the fourth pipe P4 and the first pipe P1 to exit the heat-source-side circuit RC1 and then flows through the gas-side connection pipe G1 to enter the use-side circuit RC2 in the use units 40 in operation.

After flowing into the heat-source-side circuit RC2, the refrigerant enters the use-side heat exchanger 42, in which the refrigerant exchanges heat with use-side air flow sent by the use-side fan 45 and is thus condensed. After flowing out from the use-side heat exchanger 42, the refrigerant flows into the use-side expansion valve 41, in which the pressure of the refrigerant is reduced to the low pressure in the refrigerant cycle in accordance with the opening degree of the use-side expansion valve 41, and then flows out from the use-side circuit RC2.

After flowing out from the use-side circuit RC2, the refrigerant flows through the liquid-side connection pipe L1 to enter the heat-source-side circuit RC1 in operation. After flowing into the heat-source-side circuit RC1, the refrigerant flows through the eighth pipe P8, the heat-source-side second control valve 17, the subcooler 15, the seventh pipe P7, the heat-source-side first control valve 16, and the sixth pipe P6 to enter the liquid-side inlet/outlet port of the heat-source-side heat exchanger 14.

After flowing into the heat-source-side heat exchanger 14, refrigerant in the heat-source-side heat exchanger 14 evaporates by exchanging heat with heat-source-side air flow sent by the heat-source-side fan 25. After exiting the gas-side inlet/outlet port of the heat-source-side heat exchanger 14, the refrigerant flows though the fifth pipe P5, the four-way switching valve 13, and the second pipe P2 to enter the accumulator 12. After entering the accumulator 12, the refrigerant is temporarily stored and is then sucked back into the compressor 11.

(4) Details of Controller 70

Figure 2:
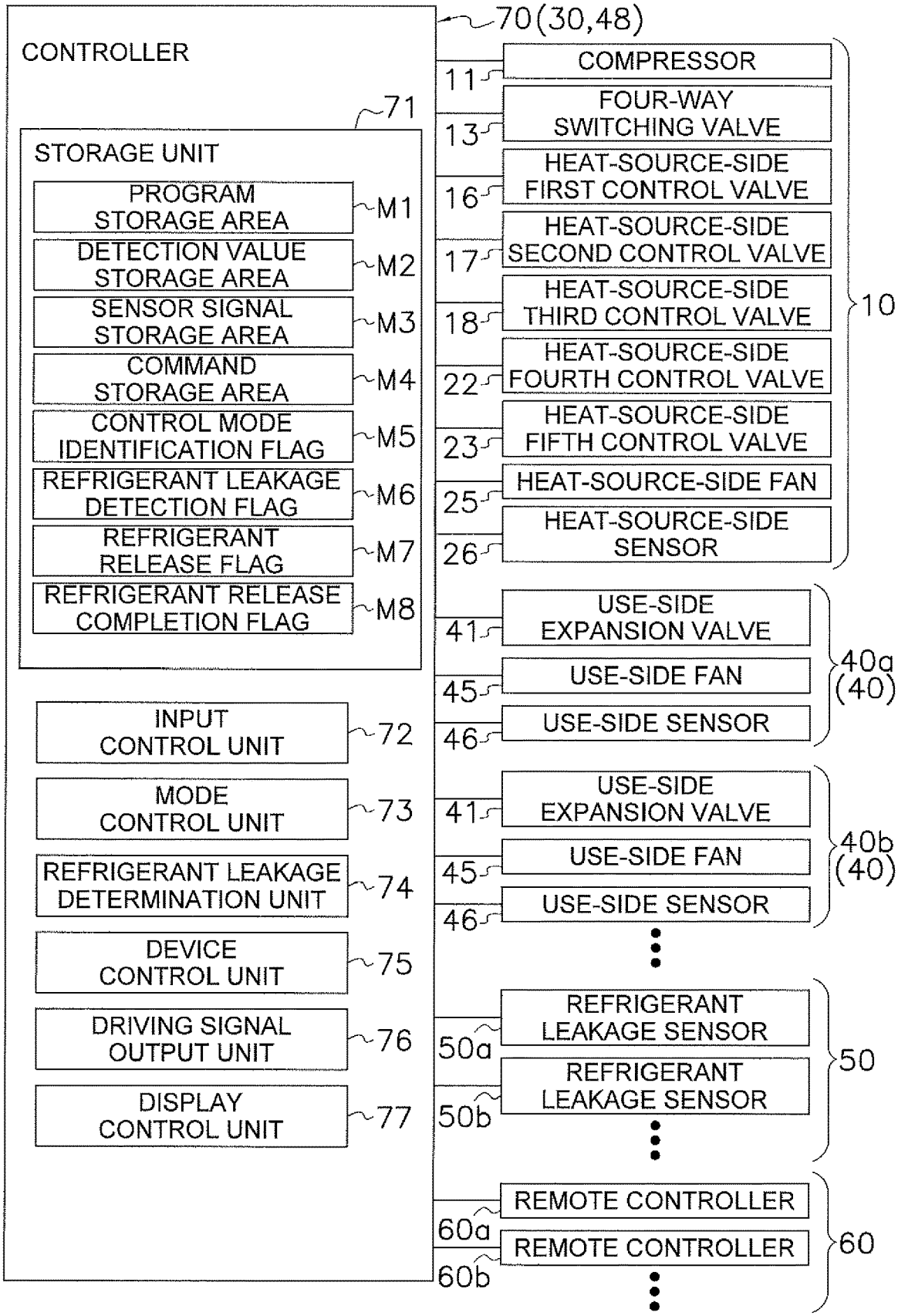
FIG. 2 is a block diagram schematically illustrating a controller and units connected to the controller.

The heat-source-unit control unit 30 and the use-unit control units 48 in the air conditioning system 100 are connected to each other through the communication line cb to constitute the controller 70. FIG. 2 is a block diagram schematically illustrating the controller 70 and units connected to the controller 70.

The controller 70 is provided with a plurality of control modes and controls the operation of the individual devices in accordance with the control mode to which a transition has been made. The controller 70 in the present embodiment is provided with control modes including: a normal operation mode to which a transition is made during operation (with no occurrence of refrigerant leakage); and a refrigerant leakage mode to which a transition is made at the time of occurrence of refrigerant leakage, or more specifically, upon detection of refrigerant leakage.

The controller 70 is electrically connected to the devices included in the air conditioning system 100, or more specifically, to the devices included in the heat source unit 10 (e.g., the compressor 11, the heat-source-side first control valve 16, the heat-source-side second control valve 17, the heat-source-side third control valve 18, the heat-source-side fourth control valve 22, the heat-source-side fifth control valve 23, the heat-source-side fan 25, and the heat-source-side sensors 26) and to the devices included in the use units 40 (e.g., the use-side expansion valves 41, the use-side fans 45, the use-side sensors 46, the refrigerant leakage sensors 50, and the remote controllers 60).

The controller 70 includes mainly a storage unit 71, an input control unit 72, a mode control unit 73, a refrigerant leakage determination unit 74, a device control unit 75, a driving signal output unit 76, and a display control unit 77. These functional units in the controller 70 are provided in such a manner that modules included in the heat-source-unit control unit 30 and/or modules included in the use-unit control units 48, such as CPUs, memories, electrical components, and electronic components, function as an integral whole.

(4-1) Storage Unit 71

The storage unit 71 is constructed of, for example, a ROM, a RAM, and flash memory and includes a volatile storage area and a nonvolatile storage area. The storage unit 71 includes a program storage area M1, in which control programs defining procedures to be performed by the individual units of the controller 70 are stored.

The storage unit 71 includes a detection value storage area M2, in which detection values acquired from the various types of sensors are to be stored. For example, detection values acquired from the heat-source-side sensors 26 and the use-side sensors 46 (e.g., the suction pressure, the discharge pressure, the discharge temperature, the temperature of refrigerant in the heat-source-side heat exchanger 14 and the temperature of refrigerant in the use-side heat exchanger 42) are stored in the detection value storage area M2.

The storage unit 71 includes a sensor signal storage area M3, in which refrigerant-leakage-sensor detection signals transmitted by the refrigerant leakage sensors 50 (detection values acquired from the refrigerant leakage sensors 50) are to be stored. The sensor signal storage area M3 includes storage area corresponding to the number of the refrigerant leakage sensors 50, and each of the received refrigerant-leakage-sensor detection signals is stored in the area corresponding to the refrigerant leakage sensor 50 from which the signal concerned is transmitted. An update of refrigerant leakage signals stored in the sensor signal storage area M3 is performed each time a refrigerant leakage signal output by the refrigerant leakage sensor 50 is received.

The storage unit 71 includes a command storage area M4, in which commands input to the remote controllers 60 are to be stored.

The storage unit 71 is provided with a plurality of flags, each of which has a predetermined number of bits. For example, the storage unit 71 is provided with a control mode identification flag M5, which enables identification of the control mode to which the controller 70 has transitioned. The control mode identification flag M5 has a number of bits corresponding to the number of the control modes, and the bit corresponding to the control mode to which a transition is made may be set.

The storage unit 71 is provided with a refrigerant leakage detection flag M6, which enables a determination on whether leakage of refrigerant in the target space has been detected. More specifically, the refrigerant leakage detection flag M6 has a number of bits corresponding to the number of the use units 40 installed, and the bit corresponding to the use unit 40 (a refrigerant leakage unit) in which leakage of refrigerant is suspected may be set.

That is, the refrigerant leakage detection flag M6 is configured in such a manner that it is distinguishable which of the use units 40 (which of the use-side circuits RC2) occurs refrigerant leakage in the event of leakage of refrigerant in the use-side circuit RC2. The refrigerant leakage detection flag M6 is switched by the refrigerant leakage determination unit 74.

The storage unit 71 is provided with a refrigerant release flag M7, which enables a determination on whether refrigerant needs to be released through the refrigerant release mechanism 21. The refrigerant release flag M7 is switched by the refrigerant leakage determination unit 74.

The storage unit 71 is provided with a refrigerant release completion flag M8, which enables a determination on whether release of refrigerant executed in the refrigerant leakage mode through refrigerant leakage fourth control, which will be described later, has been completed. The refrigerant release completion flag M8 is set upon completion of the refrigerant leakage fourth control.

(4-2) Input Control Unit 72

The input control unit 72 is a functional unit that functions as an interface for receiving signals output by the individual devices connected to the controller 70. When, for example, receiving signals output by the individual sensors (26, 46, 50) or signals output by the remote controllers 60, the input control unit 72 stores these signals in the relevant storage areas of the storage unit 71 or sets predetermined flags.

(4-3) Mode Control Unit 73

The mode control unit 73 is a functional unit that performs switching between the control modes. Under normal conditions (when the refrigerant leakage detection flag M6 is not set), the mode control unit 73 switches the control mode to the normal operation mode.

When the refrigerant leakage detection flag M6 is set, the mode control unit 73 switches the control mode to the refrigerant leakage mode. The mode control unit 73 sets the control mode identification flag M5 in accordance with the control mode to which a transition has been made.

(4-4) Refrigerant Leakage Determination Unit 74

The refrigerant leakage determination unit 74 is a functional unit that determines whether there is leakage of refrigerant in the refrigerant circuit RC (the use-side circuit RC2). Specifically, when a predetermined refrigerant leakage detection condition is satisfied, the refrigerant leakage determination unit 74 determines that there is leakage of refrigerant in the refrigerant circuit RC (the use-side circuit RC2) and sets the refrigerant leakage detection flag M6 accordingly.

In the present embodiment, a determination on whether the refrigerant leakage detection condition is satisfied is made on the basis of the refrigerant-leakage-sensor detection signals in the sensor signal storage area M3. Specifically, the refrigerant leakage detection condition is satisfied when the duration of time for which the voltage value associated with any one of the refrigerant-leakage-sensor detection signals (the detection value acquired from the refrigerant leakage sensor 50) is equal to or greater than a predetermined first reference value is equal to or greater than a predetermined period t1. The first reference value is a value (the concentration of refrigerant) from which leakage of refrigerant in the use-side circuit RC2 is suspected. The predetermined period t1 is set to be long enough to determine that the refrigerant-leakage-sensor detection signal concerned is not instantaneous. The refrigerant leakage determination unit 74 specifies the refrigerant leakage unit (the use unit 40 in which leakage of refrigerant is suspected) on the basis of the refrigerant leakage sensor 50 from which the refrigerant-leakage-sensor detection signal satisfying the refrigerant leakage detection condition is transmitted, and sets the bit of the refrigerant leakage detection flag M6 corresponding to the refrigerant leakage unit. Together with the refrigerant leakage sensors 50, the refrigerant leakage determination unit 74 is thus regarded as a "refrigerant leakage detection unit" that detects leakage of refrigerant in the use-side circuits RC2 on an individual basis.

The predetermined period t1 is set as appropriate in accordance with, for example, the type of refrigerant sealed in the refrigerant circuit RC, specifications of the individual devices, or installation environments and is defined in a control program. The refrigerant leakage determination unit 74 is configured in such a way as to be capable of measuring the predetermined period t1.

The first reference value is set as appropriate in accordance with, for example, the type of refrigerant sealed in the refrigerant circuit RC, design specifications, or installation environments and is defined in a control program.

(4-5) Device Control Unit 75

The device control unit 75 controls, as circumstances demand, operation of the individual devices (e.g., 11, 13, 16, 17, 18, 22, 23, 25, 41, and 45) in the air conditioning system 100 in accordance with the control programs. The device control unit 75 refers to the control mode identification flag M5 to identify the control mode to which a transition has been made, and then controls the operation of the individual devices in accordance with the identified control mode.

For example, the device control unit 75 in the normal operation mode controls, in real time, the operating capacity of the compressor 11, the revolution frequency of the heat-source-side fan 25, the revolution frequency of the use-side fans 45, the opening degree of the heat-source-side first control valve 16, the opening degree of the heat-source-side third control valve 18, and the opening degree of the use-side expansion valves 41 so that normal cycle operation or reverse cycle operation is performed in accordance with, for example, the set temperature or detection values acquired from the individual sensors.

During normal cycle operation, the device control unit 75 controls the four-way switching valve 13 to the normal cycle state to cause the heat-source-side heat exchanger 14 to function as a refrigerant condenser (or radiator) and to cause the use-side heat exchanger 42 in the use unit 40 in operation to function as a refrigerant evaporator. During reverse cycle operation, the device control unit 75 controls the four-way switching valve 13 to the reverse cycle state to cause the heat-source-side heat exchanger 14 to function as a refrigerant evaporator and to cause the use-side heat exchanger 42 in the use unit 40 in operation to function as a refrigerant condenser (or radiator).

Under normal conditions (when no leakage of refrigerant in the use-side circuit RC2 is detected), the device control unit 75 controls the heat-source-side fourth control valve 22 to the closed state and controls the heat-source-side fifth control valve 23 to the opened state. The device control unit 75 executes, as circumstances demand, various types of control, which will be described below. The device control unit 75 is configured in such a way as to be capable of measuring time.

<Refrigerant Leakage First Control>

When leakage of refrigerant in the target space is suspected, or more specifically, when the refrigerant leakage detection flag M6 is set, the device control unit 75 executes refrigerant leakage first control. The device control unit 75 executes the refrigerant leakage first control to control the use-side expansion valve 41 in the refrigerant leakage unit (the use unit 40 in which the refrigerant leakage occurs) to the closed state. This suppresses refrigerant flowing into the refrigerant leakage unit and will eliminate or reduce the possibility of further leakage of refrigerant. The refrigerant leakage first control is thus regarded as the control to be executed at the time of occurrence of refrigerant leakage to suppress the leakage of refrigerant in the relevant use-side circuit RC2.

<Refrigerant Leakage Second Control>

When leakage of refrigerant in the target space is suspected, the device control unit 75 executes the refrigerant leakage second control. The device control unit 75 executes refrigerant leakage second control to cause the use-side fans 45 in the respective use units 40 to run at a revolution frequency (air quantity) specified in relation to the refrigerant leakage second control. The refrigerant leakage second control is the control that causes the use-side fans 45 to run at a predetermined revolution frequency so that the leakage refrigerant concentration would not become higher in some regions of the target space.

Although the revolution frequency of the use-side fans 45 specified in relation to the refrigerant leakage second control is not limited, the present embodiment sets the revolution frequency to the maximum revolution frequency (i.e., the maximum air quantity). In the event of refrigerant leakage in the target space, the refrigerant leakage second control is executed, such that use-side air flow generated by the use-side fans 45 diffuses the leakage refrigerant in the target area, and consequently, the possibility that the concentration of leakage refrigerant in some regions of the target space will reach a dangerously high level is eliminated or reduced.

<Refrigerant Leakage Third Control>

When leakage of refrigerant in the target space is suspected, the device control unit 75 executes refrigerant leakage third control. The device control unit 75 executes the refrigerant leakage third control to control the operation of the individual devices so that pump-down operation, which enables recovery of refrigerant and its return to the heat-source-side circuit RC1, is performed. The refrigerant leakage third control is thus regarded as the control to be executed at the time of occurrence of refrigerant leakage to promote recovery of refrigerant from the use-side circuit RC2 and its return to the heat-source-side circuit RC1, to interrupt refrigerant flowing from the heat-source-side circuit RC1 to the use-side circuit RC2, and to suppress the leakage of refrigerant in the relevant use-side circuit RC2.

Specifically, the device control unit 75 executes the refrigerant leakage third control to control the four-way switching valve 13 to the normal cycle state. The device control unit 75 executes the refrigerant leakage third control also to control the heat-source-side second control valve 17 and the heat-source-side third control valve 18, which are located upstream of the use-side circuits RC2 in the direction of refrigerant flow, to the closed state and to cause the compressor 11 to operate at a predetermined revolution frequency. This will interrupt refrigerant flowing into the use-side circuits RC2 and will enable recovery of refrigerant from refrigerant circuit RC and its return to the heat-source-side circuit RC1. Although the revolution frequency of the compressor 11 specified in relation to the refrigerant leakage third control is not limited, the present embodiment sets the revolution frequency to the maximum revolution frequency to further promote the recovery of refrigerant.

<Refrigerant Leakage Fourth Control>

The device control unit 75 executes refrigerant leakage fourth control when it is suspected that refrigerant needs to be released through the refrigerant release mechanism 21 (in this embodiment, when the refrigerant release flag M7 is set subsequent to the start of pump-down operation at the time of occurrence of refrigerant leakage in the target space). The refrigerant leakage fourth control is the control for reliably ensuring the safety of the use-side circuits RC2 by causing the refrigerant release mechanism 21 to shift to the opened state to release refrigerant in the refrigerant circuit RC into the external space. Control valves (electromagnetic valves and electronic expansion valves) such as the heat-source-side second control valve 17 are structurally incapable of completely interrupting a flow of refrigerant even when being controlled to the closed state. Thus, even when the heat-source-side second control valve 17 is controlled to the closed state at the time of occurrence of refrigerant leakage, a very small amount of refrigerant flowing through the heat-source-side second control valve 17 conceivably flows into the use-side circuits RC2. In such a case, there is a concern about the possibility that leakage refrigerant may build up in the target space, and as a result, the leakage refrigerant concentration in some regions of the target space will reach a dangerously high level. The refrigerant leakage fourth control is executed to avoid such a situation without fail.

The device control unit 75 executes the refrigerant leakage fourth control to control the heat-source-side fifth control valve 23 to the closed state and to control the heat-source-side fourth control valve 22 to the opened state (the maximum opening degree). Consequently, the second channel RP2 in the refrigerant release circuit RC3 is blocked, and the first channel RP1 is opened. The first channel RP1 thus communicates with the heat-source-side circuit RC1. Further, the device control unit 75 executes the refrigerant leakage fourth control to control the heat-source-side first control valve 16 to the closed state. The refrigerant in the heat-source-side circuit RC1 consequently flows into the first channel RP1, causing a further increase in the pressure of refrigerant in the first channel RP1. Then, the pressure of refrigerant in the first channel RP1 becomes equal to or greater than the first threshold value $\Delta Th1$, and the refrigerant release mechanism 21 is activated accordingly to shift to the open state, such that refrigerant in the refrigerant circuit RC is released into the external space. That is, the device control unit 75 executes the refrigerant leakage fourth control to switch the heat-source-side fifth control valve 23 to the closed state and to switch the heat-source-side fourth control valve 22 to the opened state, such that the refrigerant release mechanism 21 shifts to the open state.

After starting the refrigerant leakage fourth control (after the release of refrigerant is started), the device control unit 75 ends the refrigerant leakage fourth control upon satisfaction of a predetermined refrigerant release completion condition. With the heat-source-side second control valve 17 being kept controlled to the closed state, the device control unit 75 causes the compressor 11 to stop operating. The device control unit 75 controls the other control valves (16, 18, 22, 23) in the heat-source-side circuit RC1 to the opened state. The refrigerant release completion condition is calculated in advance in accordance with the component configuration of the refrigerant circuit RC or design specifications, such as the amount of refrigerant charged into the refrigerant circuit RC or the revolution frequency of the compressor 11, and is defined in a control program. In the present embodiment, the refrigerant release completion condition is to be satisfied upon the lapse of a predetermined period t2 (the duration of time conceivably required to complete the release of the refrigerant from the refrigerant circuit RC) after the start of the refrigerant leakage fourth control.

(4-6) Driving Signal Output Unit 76

The driving signal output unit 76 outputs, to the individual devices (e.g., 11, 13, 16, 17, 18, 22, 23, 25, 41, and 45), corresponding driving signals (driving voltage) in accordance with the details of control executed by the device control unit 75. The driving signal output unit 76 includes a plurality of inverters (not illustrated) and outputs driving signals to particular devices (e.g., the compressor 11, the heat-source-side fan 25, and the individual use-side fans 45) from the corresponding inverters.

(4-7) Display Control Unit 77

The display control unit 77 is a functional unit that controls operation of each remote controller 60 as a display. The display control unit 77 causes the remote controller 60 to output predetermined information so that information on the operation state or condition is indicated to the user. During operation in the normal mode, the display control unit 77 causes the remote controller 60 to display various pieces of information, such as the set temperature.

When the refrigerant leakage detection flag M6 is set, the display control unit 77 causes the remote controller 60 to display the refrigerant leakage alert information. This enables the manager to ascertain the occurrence of refrigerant leakage and to take a predetermined action.

(5) Procedure Followed by Controller 70

Figure 3:
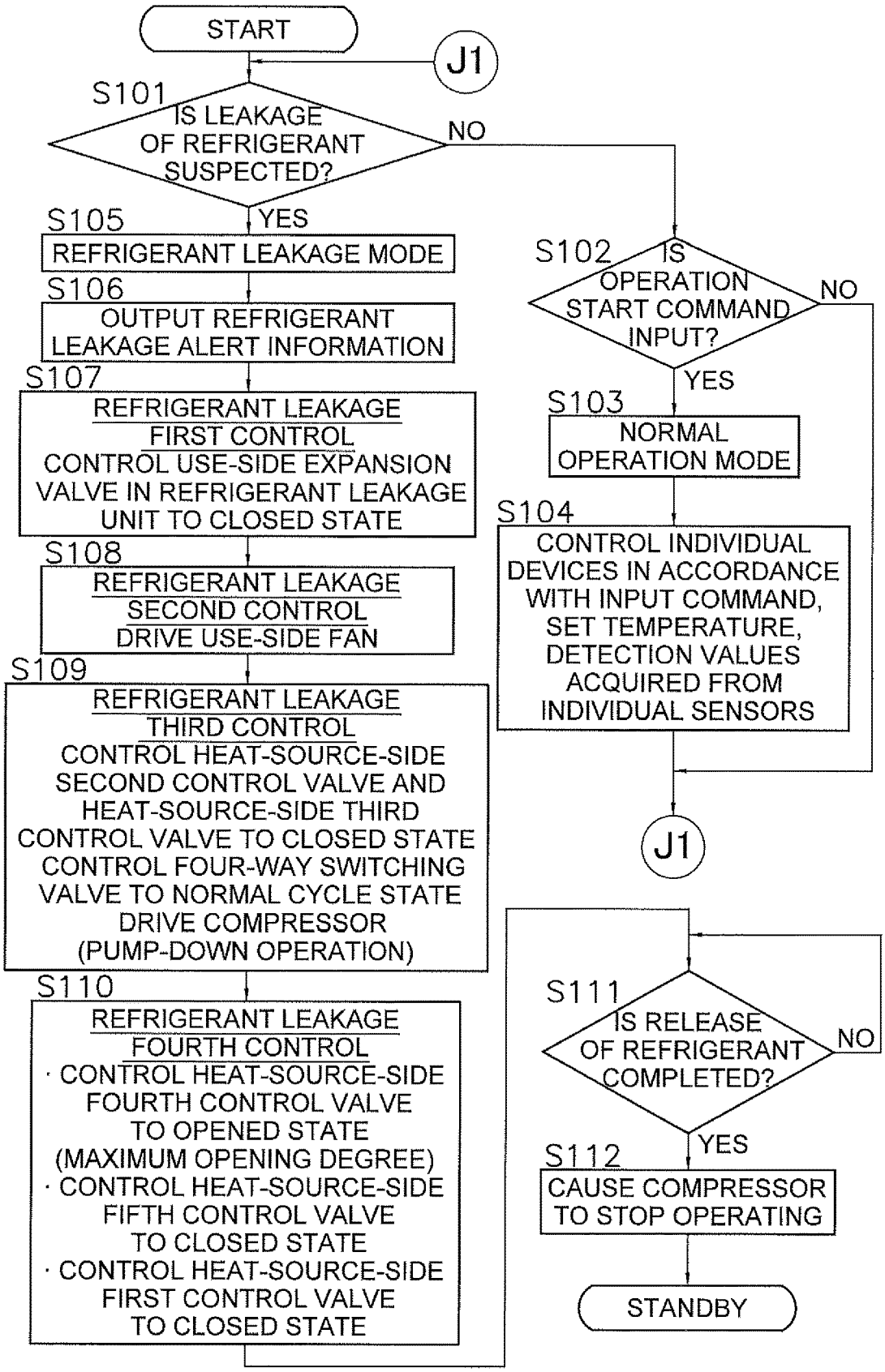
FIG. 3 is a flowchart of an example procedure executed by the controller.

The following describes, with reference to FIG. 3, an example procedure followed by the controller 70. FIG. 3 is a flowchart of the example procedure followed by the controller 70. When the power is turned on, the controller 70 follows Steps S101 to S112 of the procedure in FIG. 3. The procedure in FIG. 3 is merely provided as an example and may be altered as appropriate. For example, these steps may be carried out in a different order as long as no inconsistencies are produced, some of these steps may be carried out in parallel, or another step may be added to the procedure.

If leakage of refrigerant in the use-side circuit RC2 is suspected (i.e., if YES) in Step S101, the controller 70 proceeds to Step S105. If no leakage of refrigerant in the use-side circuit RC2 is suspected (i.e., if NO), the controller 70 proceeds to Step S102.

If an operation start command is not input (i.e., if NO) in Step S102, the controller 70 returns to Step S101. If the operation start command is input (i.e., if YES), the controller 70 proceeds to Step S103.

In Step S103, the controller 70 transitions to the normal operation mode (or remains in the normal operation mode). Then, the controller 70 proceeds to Step S104.

In Step S104, the controller 70 controls, in real time, the states of the individual devices in accordance with, for example, the input command, the set temperature, and detection values acquired from the individual sensors (26, 46) in such a manner that normal cycle operation is performed. The controller 70 causes the remote controller 60 to display various pieces of information, such as the set temperature (not illustrated). Then, the controller 70 returns to Step S101.

In Step S105, the controller 70 transitions to the refrigerant leakage mode. Then, the controller 70 proceeds to Step S106.

In Step S106, the controller 70 causes the remote controller 60 to output the refrigerant leakage alert information. This enables the manager to ascertain the occurrence of refrigerant leakage. Then, the controller 70 proceeds to Step S107.

In Step S107, the controller 70 executes the refrigerant leakage first control. Specifically, the controller 70 controls the use-side expansion valve 41 in the relevant refrigerant leakage unit to the closed state. This suppresses refrigerant flowing into the use-side circuit RC2 in the refrigerant leakage unit and will eliminate or reduce the possibility of further leakage of refrigerant. Then, the controller 70 proceeds to Step S108.

In Step S108, the controller 70 executes the refrigerant leakage second control. Specifically, the controller 70 drives the use-side fan 45 to run at a predetermined revolution frequency (e.g., the maximum revolution frequency). Consequently, the leakage refrigerant is diffused in the target space, and in turn, the possibility that the leakage refrigerant concentration in some regions of the target space will reach a dangerously high level will be eliminated or reduced. Then, the controller 70 proceeds to Step S109.

In Step S109, the controller 70 executes the refrigerant leakage third control. Specifically, the controller 70 controls the heat-source-side second control valve 17 and the heat-source-side third control valve 18 to the closed state. This suppresses refrigerant flowing into the use-side circuits RC2 and will eliminate or reduce the possibility of further leakage of refrigerant in the use-side circuits RC2. The controller 70 controls the four-way switching valve 13 to normal cycle operation and then drives the compressor 11 to perform pump-down operation. This will promote recovery of refrigerant and its return to the heat-source-side circuit RC1. Then, the controller 70 proceeds to Step S110.

In Step S110, the controller 70 executes the refrigerant leakage fourth control to control the heat-source-side fifth control valve 23 to the closed state and to control the heat-source-side fourth control valve 22 to the opened state (the maximum opening degree). Consequently, the second channel RP2 in the refrigerant release circuit RC3 is blocked, and the first channel RP1 is opened. The first channel RP1 thus communicates with the heat-source-side circuit RC1. The controller 70 controls the heat-source-side first control valve 16 to the closed state. The refrigerant in the heat-source-side circuit RC1 consequently flows into the first channel RP1, causing a further increase in the pressure of refrigerant in the first channel RP1. Then, the pressure of refrigerant in the first channel RP1 becomes equal to or greater than the first threshold value ΔTh1, and the refrigerant release mechanism 21 shifts to the open state accordingly, such that refrigerant in the refrigerant circuit RC is released into the external space. Then, the controller 70 proceeds to Step S111.

If the refrigerant release completion condition is not satisfied (if the release of refrigerant is not completed, i.e., if NO) in Step S111, the controller 70 remains in Step S111. If the refrigerant release completion condition is satisfied (if the release of refrigerant is completed, i.e., if YES), the controller 70 proceeds to Step S112.

In Step S112, the controller 70 causes the compressor 11 to stop operating. In addition, the controller 70 controls the control valves 16, 18, 22, 23, etc., to the opened state. The controller 70 then goes on standby and remains as it is until the manager makes a cancellation.

(6) Features of Air Conditioning System 100

6-1

The air conditioning system 100 according to the embodiment above reliably ensures safety against leakage of refrigerant.

A method proposed as provisions to be made to ensure safety against leakage of refrigerant involves controlling, upon detection of leakage of refrigerant, a designated control valve (an electromagnetic valve, an electronic expansion valve, or any other valve whose opening degree is adjustable) in a refrigerant circuit to a closed state to interrupt refrigerant flowing into a use-side circuit and to eliminate or reduce the possibility that refrigerant will further leak into a use-side space in which the use-side circuit is installed, such as a living space, a garage space, or any other space people may enter. When being controlled to the closed state, control valves such as electromagnetic valves and electronic expansion valves are structurally incapable of completely interrupting a flow of refrigerant, that is, the control valves may not be able to prevent refrigerant from leaking from one end side to the other end side. That is, minute refrigerant channels (microchannels) may be formed through such a control valve controlled to the closed state, and as a result, a very small amount of refrigerant may flow through the control valve.

Even if the control valve is controlled to the closed state at the time of occurrence of refrigerant leakage, there is concern about the possibility that a very small amount of refrigerant flowing through the control valve may enter a use unit and leakage refrigerant will consequently build up in the use-side space. That is, in some cases, the method disclosed in the prior art may not be able to reliably ensure safety against leakage of refrigerant.

To work around this, the controller 70 in the air conditioning system 100 is configured to switch the heat-source-side fourth control valve 22 from the closed state to the opened state and indirectly causes the refrigerant release mechanism 21 to shift to the open state (the first state) when leakage of refrigerant in the use-side circuit RC2 is detected by the "refrigerant leakage detection unit" (the refrigerant leakage sensors 50 and the refrigerant leakage determination unit 74). Thus, in the event of leakage of refrigerant in the use-side circuit RC2, the heat-source-side fourth control valve 22 is opened to allow refrigerant to flow from the heat-source-side circuit RC1 to the refrigerant release circuit RC3 (the refrigerant release mechanism 21), and the refrigerant release mechanism 21 is indirectly controlled to the open state (the first state), in which refrigerant is released into the external space through the refrigerant release mechanism 21. This suppresses refrigerant flowing from the heat-source-side circuit RC1 to the use-side circuits RC2 and will eliminate or reduce the possibility of further leakage of refrigerant in the use-side circuits RC2.

This therefore eliminates or reduces the possibility that the amount of refrigerant leaking from the use-side circuit RC2 will reach a dangerously large value, such as the lower flammable limit or a value that would lead to an oxygen deficiency. In this way, safety against refrigerant leakage is reliably ensured.

6-2

The refrigerant release mechanism 21 in the air conditioning system 100 according to the embodiment above is a rupture disk that shifts to the open state (the first state) when the pressure in the refrigerant release circuit RC3 becomes equal to or greater than the first threshold value ΔTh1. Refrigerant may therefore be released into the external space with ease and high accuracy at the time of occurrence of refrigerant leakage in the use-side circuit RC2. Safety is thus ensured with ease and high accuracy.

6-3

The controller 70 in the air conditioning system 100 according to the embodiment above is configured to control the use-side expansion valve 41 (the "pressure reducing valve") in the use-side circuit RC2 of the refrigerant leakage unit (the use unit 40 that is the location of occurrence of refrigerant leakage) to the closed state when leakage of refrigerant in the use-side circuit RC2 is detected by the "refrigerant leakage detection unit" (the refrigerant leakage sensors 50 and the refrigerant leakage determination unit 74). In the event of leakage of refrigerant in the use-side circuit RC2, this configuration suppresses refrigerant flowing into the use-side circuit RC2 in the refrigerant leakage unit and will eliminate or reduce the possibility of further leakage of refrigerant. Safety is thus more reliably ensured.

6-4

The controller 70 in the air conditioning system 100 according to the embodiment above is configured in such a manner that when leakage of refrigerant in the use-side circuit RC2 is detected by the "refrigerant leakage detection unit" (the refrigerant leakage sensors 50 and the refrigerant leakage determination unit 74), the controller 70 controls the use-side heat exchanger 42 to the normal cycle state, controls the heat-source-side second control valve 17 (the "first valve") to the closed state, and causes the compressor 11 to operate. Thus, in the event of leakage of refrigerant in the use-side circuit RC2, normal cycle operation (pump-down operation) is performed, with the heat-source-side second control valve 17 being in the closed state. This further suppresses refrigerant flowing from the heat-source-side circuit RC1 to the use-side circuits RC2 and will promote recovery of refrigerant from the use-side circuit RC2 and its return to the heat-source-side circuit RC1. Safety is thus more reliably ensured.

6-5

The refrigerant release circuit RC3 in the air conditioning system 100 according to the embodiment above includes: the first channel RP1, one end of which is connected to the heat-source-side circuit RC1; and the second channel RP2, which is connected the heat-source-side circuit RC1 independently of the first channel RP1. The heat-source-side fourth control valve 22 is disposed on the first channel RP1 and allows, when being in the opened state, refrigerant to flow from the heat-source-side circuit RC1 to the first channel RP1. The heat-source-side fifth control valve 23 is disposed on the second channel RP2 and allows, when being in the opened state, refrigerant to flow from the second channel RP2 to the heat-source-side circuit RC1. The pressure regulating valve 24 is disposed on the second channel RP2 between the heat-source-side fourth control valve 22 and the heat-source-side circuit RC1 to release the pressure in the refrigerant release circuit RC3 to the heat-source-side circuit RC1 when the pressure in the refrigerant release circuit RC3 becomes equal to or greater than the third threshold value ΔTh3. When the pressure in the refrigerant release circuit RC3 rises (becomes equal to or greater than the third threshold value ΔTh3) with no occurrence of refrigerant leakage in the use-side circuit RC2, refrigerant is thus conveyed from the refrigerant release circuit RC3 to the heat-source-side circuit RC1 via the pressure regulating valve 24, and the pressure may be reduced accordingly.

6-6

The controller 70 is configured to control the heat-source-side fourth control valve 22 to the opened state when no leakage of refrigerant in the use-side circuit RC2 is detected by the "refrigerant leakage detection unit" (the refrigerant leakage sensors 50 and the refrigerant leakage determination unit 74), and the controller 70 is also configured to switch the heat-source-side fourth control valve 22 to the closed state when leakage of refrigerant in the use-side circuit RC2 is detected by the "refrigerant leakage detection unit".

When the pressure in the refrigerant release circuit RC3 rises (becomes equal to or greater than the third threshold value ΔTh3) with no occurrence of refrigerant leakage in the use-side circuit RC2, refrigerant is thus conveyed from the refrigerant release circuit RC3 to the heat-source-side circuit RC1 via the pressure regulating valve 24. This provides added reliability in relation to liquid seal in the refrigerant release circuit RC3 and to malfunctions of the refrigerant release mechanism 21.

(7) Modifications

As described in the following modifications, the embodiment above may be modified as appropriate. There modifications may be employed in combination as long as no inconsistencies are produced.

(7-1) Modification 1

As a "refrigerant release mechanism" that is disposed in the refrigerant release circuit RC3 and is to be controlled to the open state at the time of occurrence of refrigerant leakage, the refrigerant release mechanism 21 (a rupture disk) is disposed in the air conditioning system 100 according to the embodiment above as illustrated in FIG. 1. The refrigerant release mechanism disposed in the refrigerant release circuit RC3 is not necessarily limited to the refrigerant release mechanism 21 (the rupture disk) and may be replaced, as appropriate, with any device capable of being in the open state to enable the refrigerant release circuit RC3 to communicate with the external space.

Figure 4:
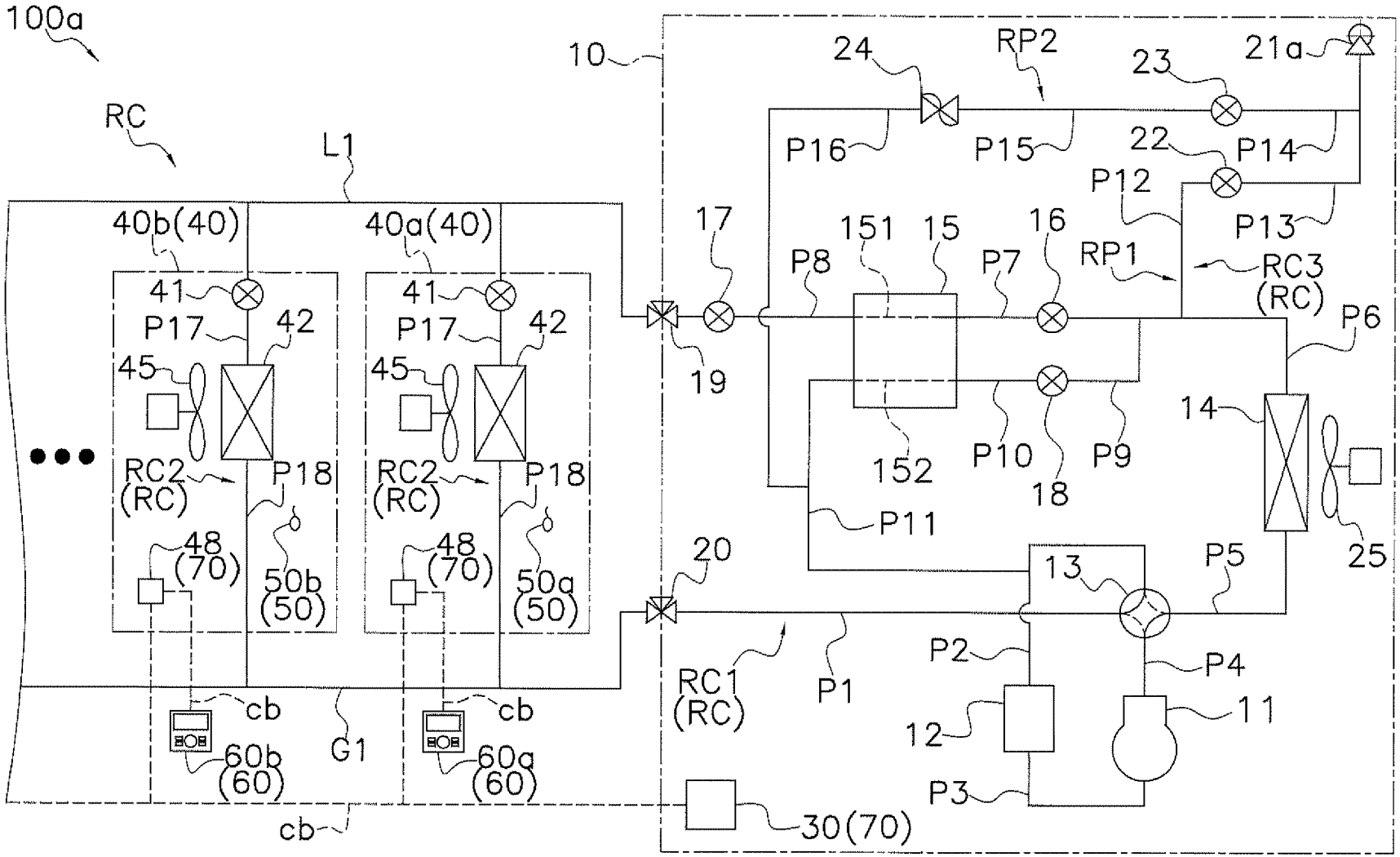
FIG. 4 is a schematic configuration diagram of an air conditioning system according to Modification 1.

As the "refrigerant release mechanism", a refrigerant release mechanism 21*a* may, for example, be disposed in the refrigerant release circuit RC3 in an air conditioning system 100*a* illustrated in FIG. 4. The refrigerant release mechanism 21*a* is a relief valve (a safety valve) that interrupts, under the normal conditions, refrigerant flowing from one end side to the other end side, and shifts to the open state (the first state) to allow refrigerant to flow to the other end side (the external space) when the pressure of the refrigerant on the one end side (in the refrigerant release circuit RC3) reaches or exceeds a second threshold value ΔTh2. The relief valve to be used may be a well-known relief valve, which is not limited to a particular model and may be of a type that includes an elastic body to adjust the valve element position. The second threshold value ΔTh2 herein refers to a set pressure at which the relief valve is activated, and this value is greater than the third threshold value ΔTh3. The second threshold value ΔTh2 is set to be smaller than the discharge pressure in the compressor 11 and is set, for example, to be equal to the first threshold value ΔTh1. The second threshold value ΔTh2 may be adjusted as appropriate in accordance with design specifications or installation environments (may be set to a value that is not equal to the first threshold value ΔTh1).

The air conditioning system 100*a* involves actions and effects similar to those involved in the embodiment above. Specifically, in the event of leakage of refrigerant, the controller 70 in the air conditioning system 100*a* executes the refrigerant leakage fourth control to control the heat-source-side fifth control valve 23 to the closed state and to control the heat-source-side fourth control valve 22 to the opened state (the maximum opening degree), such that the second channel RP2 in the refrigerant release circuit RC3 is blocked and the first channel RP1 is opened. The first channel RP1 thus communicates with the heat-source-side circuit RC1, and refrigerant in the heat-source-side circuit RC1 consequently flows into the first channel RP1, causing an increase in the pressure of refrigerant in the first channel RP1. Then, the pressure of refrigerant in the first channel RP1 becomes equal to or greater than the first threshold value ΔTh1, and the refrigerant release mechanism 21*a* (the relief valve) shifts to the open state, that is, the refrigerant release mechanism 21*a* is indirectly controlled to the open state by the controller 70 accordingly, such that refrigerant in the refrigerant circuit RC is released into the external space. This suppresses refrigerant flowing from the heat-source-side circuit RC1 to the use-side circuits RC2 and will eliminate or reduce the possibility of further leakage of refrigerant in the use-side circuits RC2.

The air conditioning system 100*a* thus eliminates or reduces the possibility that the amount of refrigerant leaking from the use-side circuit RC2 will reach a dangerously large value, such as the lower flammable limit or a value that would lead to an oxygen deficiency. In this way, safety against refrigerant leakage is reliably ensured.

Owing to the use of the refrigerant release mechanism 21*a* (the relief valve) as the refrigerant release mechanism, refrigerant may be released into the external space with ease and high accuracy at the time of occurrence of refrigerant leakage in the use-side circuit RC2.

(7-2) Modification 2

Figure 5:
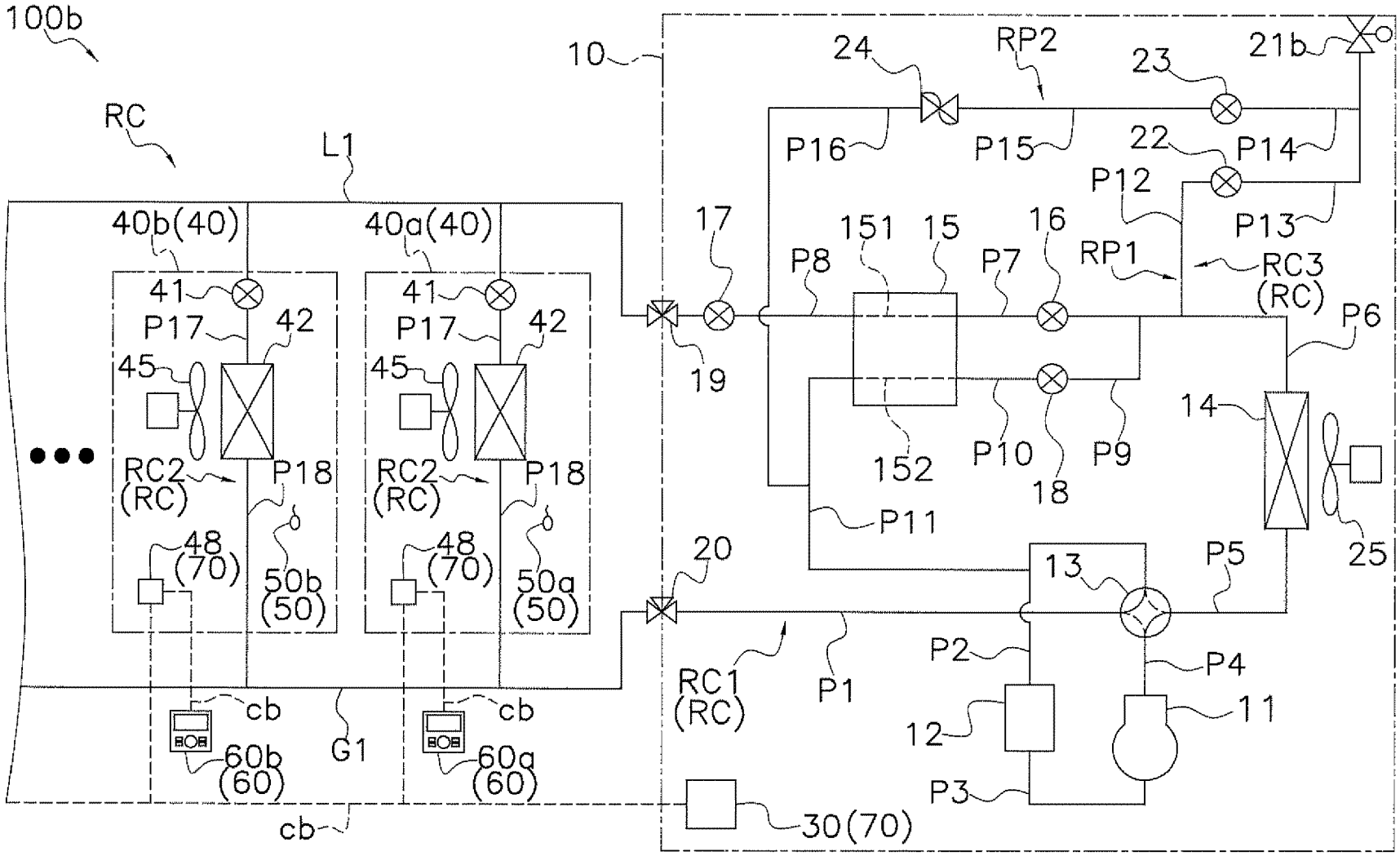
FIG. 5 is a schematic configuration diagram of an air conditioning system according to Modification 2.

As the "refrigerant release mechanism", a refrigerant release mechanism 21*b* may, for example, be disposed in the refrigerant release circuit RC3 in an air conditioning system 100*b* illustrated in FIG. 5. The refrigerant release mechanism 21*b* is an electromagnetic valve capable of switching between the opened state and the closed state. The refrigerant release mechanism 21*b* (the electromagnetic valve) is electrically connected to the controller 70 and may be controlled to the opened state (the first state) to shift to the open state, in which the refrigerant release circuit RC3 communicates with the external space.

The air conditioning system 100*b* may involve actions and effects similar to those involved in the embodiment above in such a manner that the controller 70 executes the refrigerant leakage fourth control (Step S110 in FIG. 3) to control the refrigerant release mechanism 21*b* (the electromagnetic valve) to the opened state (the open state). Specifically, in the event of leakage of refrigerant, the controller 70 in the air conditioning system 100*b* executes the refrigerant leakage fourth control to control the heat-source-side fifth control valve 23 to the closed state and to control the heat-source-side fourth control valve 22 to the opened state (the maximum opening degree), such that the second channel RP2 in the refrigerant release circuit RC3 is blocked and the first channel RP1 is opened to communicate with the heat-source-side circuit RC1. Refrigerant in the heat-source-side circuit RC1 is consequently conveyed to the first channel RP1. The refrigerant leakage fourth control is executed also to directly control the refrigerant release mechanism 21*b* (the electromagnetic valve) to the opened state, such that the refrigerant release circuit RC3 communicates with the external space. The refrigerant conveyed from the heat-source-side circuit RC1 to the first channel RP1 is consequently released into the external space. This suppresses refrigerant flowing from the heat-source-side circuit RC1 to the use-side circuits RC2 and will eliminate or reduce the possibility of further leakage of refrigerant in the use-side circuits RC2.

The air conditioning system 100*b* thus eliminates or reduces the possibility that the amount of refrigerant leaking from the use-side circuit RC2 will reach a dangerously large value, such as the lower flammable limit or a value that would lead to an oxygen deficiency. In this way, safety against refrigerant leakage is reliably ensured.

Owing to the use of the refrigerant release mechanism 21*b* (the electromagnetic valve) as the refrigerant release mechanism, refrigerant may be released into the external space with ease and high accuracy at the time of occurrence of refrigerant leakage in the use-side circuit RC2.

Instead of being an electromagnetic valve, the refrigerant release mechanism 21*b* may be an electronic expansion valve whose opening degree is adjustable. This configuration also involves similar actions and effects.

(7-3) Modification 3

Figure 6:
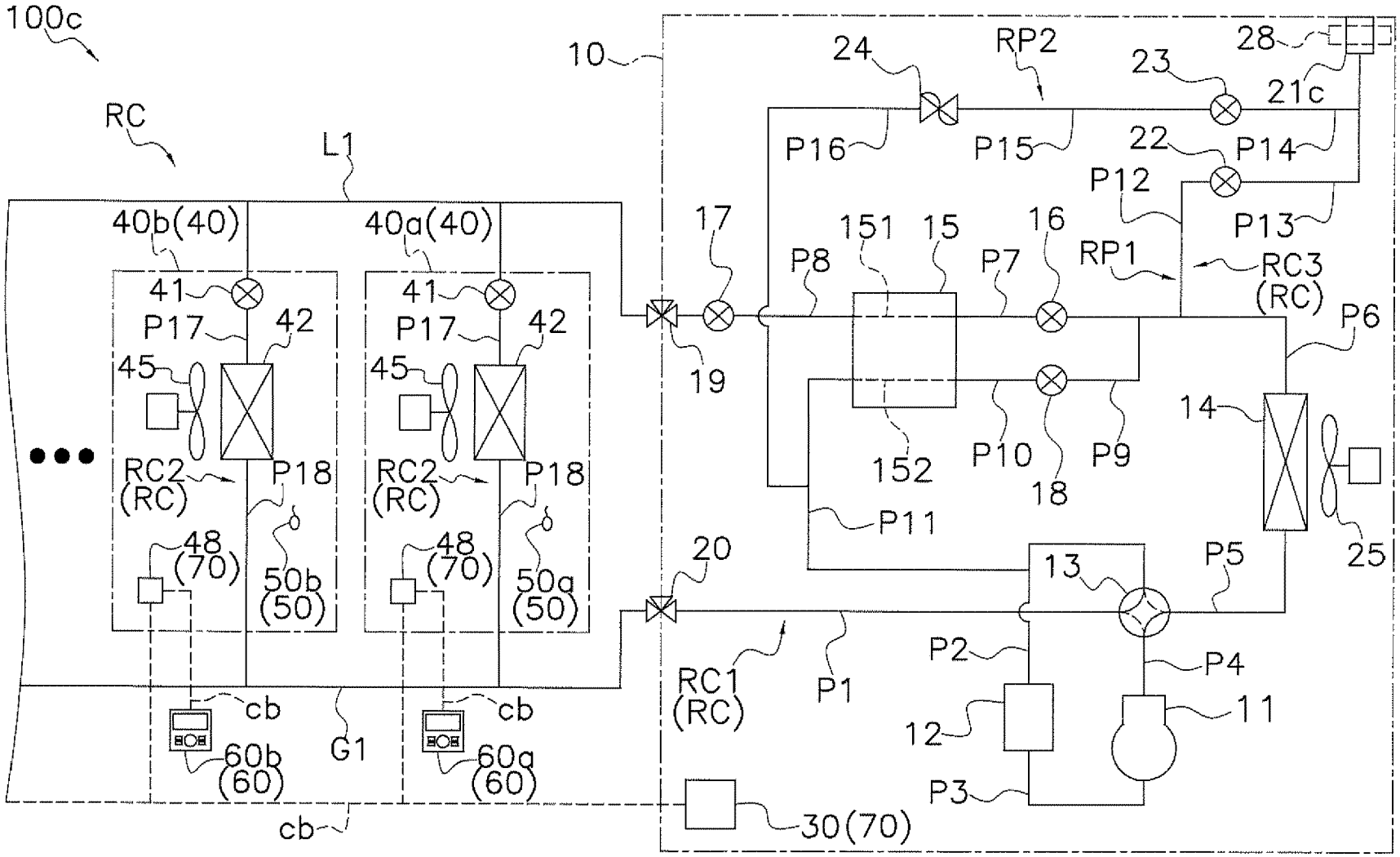
FIG. 6 is a schematic configuration diagram of an air conditioning system according to Modification 3.

As the "refrigerant release mechanism", a refrigerant release mechanism 21*c* may, for example, be disposed in the refrigerant release circuit RC3 in an air conditioning system 100*c* illustrated in FIG. 6. The refrigerant release mechanism 21*c* is a well-known fusible plug designed to melt by the application of heat (a fusible plug that has been commonly used as a safety device). The component configuration of the fusible plug is not limited, and the fusible plug may be a threaded component having a through-hole filled with low-melting metal. The material of the low-melting metal is not limited, and an alloy containing an indium content of 63.5% by mass, a bismuth content of 35% by mass, a tin content of 0.5% by mass, and an antimony content of 1.0% may be used.

When the refrigerant release mechanism 21*c* is heated by a predetermined heating means to a predetermined first temperature Tel or higher, the low-melting metal melts, and the refrigerant release mechanism 21*c* thus shifts to the open state (the first state), in which fluid can flow through the through-hole. When the refrigerant release mechanism 21*c* is in an open state, refrigerant in the refrigerant release circuit RC3 is released into the outside.

The air conditioning system 100*c* includes a heating unit 28, which is disposed around the refrigerant release mechanism 21*c* to heat the refrigerant release mechanism 21*c* (the fusible plug) directly or indirectly. The controller 70 controls the state of the heating unit 28, which may thus shift to a heat generation state to heat the refrigerant release mechanism 21*c* to the first temperature Tel or higher. The heating unit 28 is, for example, an electric heater that shifts to the heat generation state upon energization.

The controller 70 in the air conditioning system 100*c* executes the refrigerant leakage fourth heat generation control (Step S110 in FIG. 3) to control the heating unit 28 to the heat generation state. The refrigerant release mechanism 21*c* is consequently heated to the first temperature Tel or higher and shifts to the open state accordingly.

The air conditioning system 100*c* may involve actions and effects similar to those involved in the embodiment above. Specifically, in the event of leakage of refrigerant, the controller 70 in the air conditioning system 100*c* executes the refrigerant leakage fourth control to control the heat-source-side fifth control valve 23 to the closed state and to control the heat-source-side fourth control valve 22 to the opened state (the maximum opening degree), such that the second channel RP2 in the refrigerant release circuit RC3 is blocked and the first channel RP1 is opened to communicate with the heat-source-side circuit RC1. Refrigerant in the heat-source-side circuit RC1 is consequently conveyed to the first channel RP1. The controller 70 in the air conditioning system 100*c* executes the refrigerant leakage fourth control to control the heating unit 28 to the heat generation state so that the refrigerant release mechanism 21*c* is heated to the first temperature Tel or higher. The refrigerant release mechanism 21*c* is consequently heated to the first temperature Tel or higher to shift to the open state, that is, the refrigerant release mechanism 21*c* is indirectly controlled to the open state by the controller 70, such that the refrigerant conveyed from the heat-source-side circuit RC1 to the first channel RP1 is released into the external space. This suppresses refrigerant flowing from the heat-source-side circuit RC1 to the use-side circuits RC2 and will eliminate or reduce the possibility of further leakage of refrigerant in the use-side circuits RC2.

The air conditioning system 100*c* thus eliminates or reduces the possibility that the amount of refrigerant leaking from the use-side circuit RC2 will reach a dangerously large value, such as the lower flammable limit or a value that would lead to an oxygen deficiency. In this way, safety against refrigerant leakage is reliably ensured.

Owing to the use of the refrigerant release mechanism 21*c* (the fusible valve) as the refrigerant release mechanism, refrigerant may be released into the external space with ease and high accuracy at the time of occurrence of refrigerant leakage in the use-side circuit RC2.

When the release of refrigerant is conceivably completed (i.e., when the refrigerant release completion flag M8 is set) after the execution of the refrigerant leakage fourth control, the controller 70 in the air conditioning system 100*c* is to clear the heat generation state of the heating unit 28.

The heating unit 28 is not necessarily limited to an electric heater and may be any device capable of shifting to the heat generation state to heat the refrigerant release mechanism 21*c* to the first temperature Tel or higher. For example, the heating unit 28 may be a hot gas pipe through which high-pressure hot gas discharged from the compressor 11 flows. When being thermally connected to the refrigerant release mechanism 21*c* (the fusible plug) at the time of occurrence of refrigerant leakage, such a pipe may involve actions and effects similar to those involved in the case of using an electric heater. In this case, the refrigerant leakage fourth control is executed so that the hot gas pipe communicates with the compressor 11 and the compressor 11 is driven to operate at a predetermined revolution frequency to convey hot gas into the hot gas pipe. The refrigerant release mechanism 21*c* is consequently heated to the first temperature Tel or higher and shifts to the open state accordingly. This example suggests that together with the hot gas pipe, the compressor 11 may be regarded as a "heating unit" that directly or indirectly heats the refrigerant release mechanism 21*c*.

(7-4) Modification 4

The heat-source-side second control valve 17 in the embodiment above functions as the control valve (the "first valve" in the appended claims) that is to be subjected to the refrigerant leakage third control (pump-down operation), in which the control valve is controlled to the closed state to interrupt refrigerant flowing into the use-side circuits RC2 at the time of occurrence of refrigerant leakage. The first vale is not necessarily limited to the heat-source-side second control valve 17 and another valve may function as the "first valve".

For example, an electromagnetic valve may be disposed on the liquid-side connection pipe L1 and may function as the "first valve" by being switched to the closed state in the refrigerant leakage third control. This may involve actions and effects similar to those involved in the embodiment above.

Alternatively, each of the use-side expansion valves 41 in the use units 40 may function as the "first valve" by being switched to the closed state in the refrigerant leakage third control. This may involve actions and effects similar to those involved in the embodiment above.

(7-5) Modification 5

The embodiment above describes that the heat-source-side second control valve 17, the heat-source-side fourth control valve 22, and the heat-source-side fifth control valve 23 are electronic expansion valves. Alternatively, the heat-source-side second control valve 17, the heat-source-side fourth control valve 22, and/or the heat-source-side fifth control valve 23 may be any control valve (e.g., an electromagnetic valve) capable of switching between the closed state and the opened state.

(7-6) Modification 6

The embodiment above describes that the refrigerant leakage first control, the refrigerant leakage second control, the refrigerant leakage third control, and the refrigerant leakage fourth control (Steps S107 to S110 in FIG. 3) are executed when leakage of refrigerant in the use-side circuit RC2 is detected. It is preferred that the refrigerant leakage first control is executed with a view to eliminating or reducing the possibility that the concentration of refrigerant in some regions of the target space will become higher. It is preferred that the refrigerant leakage second control and the refrigerant third control are executed with a view to suppressing refrigerant flowing into the refrigerant leakage unit and to eliminating or reducing the possibility of further leakage of refrigerant. It should be noted that in terms of the actions and effects mentioned above in (6-1), the refrigerant leakage first control, the refrigerant leakage second control, and/or the refrigerant leakage third control is not always necessary and may be omitted as appropriate. That is, a part of or all of Steps S107 to S109 in FIG. 3 may be omitted as appropriate. In such a case, the refrigerant leakage fourth control (Step S110) may involve activating the compressor 11.

(7-7) Modification 7

The component configuration of the refrigerant circuit RC (the heat-source-side circuit RC1, the use-side circuits RC2 and/or the refrigerant release circuit RC3) in the embodiment above is not necessarily limited to the component configurations illustrated in FIGS. 1 and 4 to 6 and may be altered in accordance with design specifications or installation environments. Example alterations are as follows.

It is not always required that the heat-source-side second control valve 17 be disposed in the heat-source-side circuit RC1. The heat-source-side second control valve 17 may, for example, be disposed on the liquid-side connection pipe L1.

It is not always required that the heat-source-side fourth control valve 22 be disposed in the refrigerant release circuit RC3. The heat-source-side fourth control valve 22 may, for example, be disposed in the heat source-side circuit RC1 (on the sixth pipe P6 or on a pipe branched therefrom).

The second channel RP2 is formed in the refrigerant release circuit RC3. The component configuration of the second channel RP2 may be altered as appropriate. Specifically, the second channel RP2 in the embodiment above is structured in such a manner that one end thereof is connected to a portion of the first channel RP1 between its two ends and the other end is connected to the eleventh pipe P11. It is not always required that the second channel RP2 be structured as described above. For example, the other end of the second channel RP2 may be connected to any other portion that would not significantly interfere with operation (any one of the first pipe P1 to the tenth pipe P10, the liquid-side connection pipe L1, or the gas-side connection pipe G1).

From the viewpoint of reducing the possibility of malfunctions of the refrigerant release mechanism 21 and avoiding liquid seal in the refrigerant release circuit RC3, the second channel RP2 is preferably configured as in the embodiment above. From the viewpoint of releasing refrigerant in the refrigerant circuit RC into the outside at the time of occurrence of refrigerant leakage, however, the second channel RP2 (the heat-source-side fifth control valve 23 and the pressure regulating valve 24) is not always necessary and may be omitted as appropriate.

The layout position of the refrigerant release circuit RC3 is not limited the one illustrated in, for example, FIG. 1 and may be changed as appropriate. For example, the refrigerant release circuit RC3 may be structured in such a way as to be connected to the fifth pipe P5 in the heat-source-side circuit RC1.

(7-8) Modification 8

The refrigerant leakage sensors 50 for detecting leakage of refrigerant in the refrigerant circuits RC (the use-side circuits RC2) in the embodiment above are disposed in the respective use units 40. From the viewpoint of promptly detecting leakage of refrigerant flowing out from the use-side circuits RC2, the refrigerant leakage sensors 50 are preferably disposed in the respective use units 40. It is, however, not always required that the refrigerant leakage sensors 50 be disposed in the respective use units 40 as long as these sensors can detect leakage of refrigerant flowing out from the use-side circuits RC2. For example, the refrigerant leakage sensors 50 may be disposed in a position that is within the target space and outside the use units 40.

(7-9) Modification 9

The embodiment above describes that the refrigerant leakage sensors 50 that directly detect refrigerant leaking from the corresponding use-side circuits RC2 are used as the "refrigerant circuit leakage detection unit" for detecting leakage of refrigerant in the refrigerant circuit RC (the use-side circuits RC2). However, the refrigerant leakage sensors 50 are not necessary if the occurrence of refrigerant leakage can be detected. The refrigerant leakage determination unit 74 may use detection values acquired from other sensors to determine whether leakage of refrigerant has occurred. The occurrence of refrigerant leakage may, for example, be determined on the basis of the state of refrigerant in accordance with detection values acquired from the heat-source-side sensor 26 or the use-side sensors 46 disposed in the refrigerant circuit RC. Together with the refrigerant leakage determination unit 74, the sensor concerned in this case is regarded as the "refrigerant leakage detection unit".

When the occurrence of refrigerant leakage is to be determined in accordance with detection values acquired from another sensor instead of detection values acquired from the refrigerant leakage sensors 50, the refrigerant leakage detection condition may be set as appropriate in accordance with, for example, the type of refrigerant in the refrigerant circuit RC, the sensor type, design specifications, or installation environments. The refrigerant leakage detection condition is to be satisfied, for example, upon the lapse of a predetermined period over which detection values acquired from the sensor are equal to or greater than a predetermined threshold value or are less than a predetermined threshold value.

(7-10) Modification 10

After starting the refrigerant leakage fourth control (after the release of refrigerant is started), the controller 70 in the embodiment above causes the compressor 11 to stop operating and shifts to the standby state when a predetermined refrigerant release completion condition is satisfied. The refrigerant release completion condition is to be satisfied upon the lapse of the predetermined period t2 after the start of the refrigerant leakage fourth control. The refrigerant release completion condition is not necessarily limited to this condition, and may be changed as appropriate in accordance with, for example, design specifications or installation environments to any other condition that enables a determination on whether the release of refrigerant in the refrigerant circuit RC has been completed. For example, a determination on whether the refrigerant release completion condition is satisfied may be made on the basis of detection values acquired from the individual sensors (26, 46).

(7-11) Modification 11

In the air conditioning system 100 in the embodiment above, one heat source unit 10 is connected to the plurality of use units 40 via the connection pipes (G1, L1). The number of the heat source units 10 and/or the number of the use units 40 may be changed as appropriate in accordance with installation environments or design specifications. For example, a plurality of heat source units 10 may be disposed in series or in parallel. Alternatively, one use unit 40 alone may be connected to one heat source unit 10.

(7-12) Modification 12

The controller 70 in the embodiment above causes the remote controller 60 to output the refrigerant leakage alert information, such that the remote controller 60 functions as an "output unit" for outputting predetermined information (alert information such as the refrigerant leakage alert information). Alternatively, a device other than the remote controller 60 may be configured to output predetermined information to function as the "output unit".

For example, a speaker capable of outputting sound of a voice may be disposed to output, as the refrigerant leakage alert information, predetermined alarm sounds or voice message. Alternatively, an LED lamp or any other light source that blinks or lights up to output alert information such as the refrigerant leakage alert information may be disposed. Still alternatively, a unit capable of outputting information may be disposed in a centralized control device or any other device installed in a remote place distant from a facility or a site to which the air conditioning system 100 is applied so that the unit can output alert information such as the refrigerant leakage alert information.

When being not necessary, the remote controller 60 may be omitted as appropriate.

(7-13) Modification 13

The embodiment above describes that the heat-source-unit control unit 30 and the use-unit control units 48 are connected to each other via the communication line cb to constitute the controller 70, which controls the operation of the air conditioning system 100. The component configuration of the controller 70 is not necessarily limited to this example and may be altered as appropriate in accordance with design specifications or installation environments. Thus, the component configuration of the controller 70 is not limited and may be any component configuration that can provide the elements (71 to 77) of the controller 70. Specifically, some or all of the elements (71 to 77) of the controller 70, which are not necessarily disposed in the heat source unit 10 or the use units 40, may be disposed in other devices or may be disposed discretely.

For example, instead of or together with the heat-source-unit control unit 30 and/or the use-unit control units 48, the remote controllers 60 and other devices such as a centralized control device may constitute the controller 70. In this case, these devices may be disposed in a remote place connected to the heat source unit 10 or the use units 40 through a communication network.

Alternatively, the controller 70 may be constructed of the heat-source-unit control unit 30 alone.

(7-14) Modification 14

The embodiment above describes that R32 is used as the refrigerant that circulates through the refrigerant circuit RC. The refrigerant to be used in the refrigerant circuit RC is not limited and may be a refrigerant other than R32. In place of R32, a refrigerant such as HFO1234yf or HFO1234ze(E) or a mixture of these refrigerants may be used in the refrigerant circuit RC. Alternatively, an HFC-based refrigerant such as R407C or R410A may be used in the refrigerant circuit RC. Still alternatively, a refrigerant such as $CO_2$ may be used in the refrigerant circuit RC.

(7-15) Modification 15

The embodiment above describes that the idea according to the present disclosure is applied to the air conditioning system 100. Furthermore, the ideas according to the present disclosure is also applicable to other refrigeration apparatuses including refrigerant circuits (e.g., water heaters and heat pump chillers).

(7-16) Modification 16

Together with at least one of the refrigerant release mechanism 21*a* (the relief valve) mentioned in Modification 1, the refrigerant release mechanism 21*b* (the electromagnetic valve or the electronic expansion valve) mentioned in Modification 2, and the refrigerant release mechanism 21*c* (the fusible plug) mentioned in Modification 3, the refrigerant release mechanism 21 (the rupture disk) in the embodiment above may be disposed in the refrigerant release circuit RC3. Thus, refrigerant may be released into the external space with higher accuracy at the time of occurrence of refrigerant leakage in the use-side circuit RC2. Furthermore, the amount of refrigerant released into the external space per unit time may be increased.

8

While various embodiments have been described herein above, it is to be appreciated that various changes in form and detail may be made without departing from the spirit and scope presently or hereafter claimed.

INDUSTRIAL APPLICABILITY

The present disclosure is applicable to refrigeration apparatuses including refrigerant circuits.

REFERENCE SIGNS LIST

10: heat source unit
11: compressor
12: accumulator
13: four-way switching valve (channel-switching valve)
14: heat-source-side heat exchanger
15: subcooler
16: heat-source-side first control valve
17: heat-source-side second control valve (first valve)
18: heat-source-side third control valve
19: liquid-side shutoff valve
20: gas-side shutoff valve
21, 21*a*, 21*b*, 21*c*: refrigerant release mechanism
22: heat-source-side fourth control valve (control valve)
23: heat-source-side fifth control valve (second control valve)
24: pressure regulating valve
25: heat-source-side fan
26: heat-source-side sensor
28: heating unit
30: heat-source-unit control unit
40 (40*a*, 40*b*): use unit
41: use-side expansion valve (pressure reducing valve)
42: use-side heat exchanger
45: use-side fan
46: use-side sensor
48: use-unit control unit
50 (50*a*, 50*b*): refrigerant leakage sensor (refrigerant leakage detection unit)
60 (60*a*, 60*b*): remote controller
70: controller (control unit)
74: refrigerant leakage determination unit (refrigerant leakage detection unit)
100, 100*a*, 100*b*, 100*c*: air conditioning system
151: main channel
152: subchannel
G1: gas-side connection pipe
L1: liquid-side connection pipe Pb to P18: first to eighteenth pipe
RC: refrigerant circuit
RC1: heat-source-side circuit
RC2: use-side circuit
RC3: refrigerant release circuit
RP1: first channel
RP2: second channel

CITATION LIST

Patent Literature

PTL 1: Japanese Unexamined Patent Application Publication No. H5-118720

The invention claimed is:

1. A refrigeration apparatus comprising:

a refrigerant circuit including a use-side circuit, a heat-source-side circuit connected to the use-side circuit, and a refrigerant release circuit connected to the heat-source-side circuit;

a refrigerant leakage detector that detects leakage of refrigerant in the use-side circuit;

a control valve that is disposed in the refrigerant release circuit or the heat-source-side circuit and enables, when being in an opened state, the heat-source-side circuit to communicate with the refrigerant release circuit;

a rupture disk that is disposed in the refrigerant release circuit and enables, when being in a first state, the refrigerant release circuit to communicate with an external space outside the refrigerant circuit, such that refrigerant in the refrigerant release circuit is released into the external space; and a controller that controls states of devices, wherein when no leakage of refrigerant in the use-side circuit is detected by the refrigerant leakage detector, the controller controls the control valve to a closed state, when leakage of refrigerant in the use-side circuit is detected by the refrigerant leakage detector, the controller switches the control valve from the closed state to the opened state and causes the rupture disk to shift to the first state, and the rupture disk shifts to the first state when a pressure in the refrigerant release circuit becomes equal to or greater than a first threshold value.

2. The refrigeration apparatus according to claim 1, wherein the refrigerant release circuit further includes a first channel and a second channel, one end of the first channel being connected to the heat-source-side circuit, the second channel being connected to the heat-source-side circuit independently of the first channel, when being in the opened state, the control valve allows refrigerant to flow from the heat-source-side circuit to the first channel, the refrigeration apparatus further comprises:

a second control valve that is disposed on the second channel and allows, when being in the opened state, refrigerant to flow from the second channel to the heat-source-side circuit; and a pressure regulating valve disposed on the second channel between the second control valve and the heat-source-side circuit to release the pressure in the refrigerant release circuit to the heat-source-side circuit when the pressure in the refrigerant release circuit becomes equal to or greater than another threshold value.

3. The refrigeration apparatus according to claim 2, wherein when no leakage of refrigerant in the use-side circuit is detected by the refrigerant leakage detector, the controller controls the second control valve to the opened state, and when leakage of refrigerant in the use-side circuit is detected by the refrigerant leakage detector, the controller switches the second control valve from the opened state to the closed state.

4. The refrigeration apparatus according to claim 1, further comprising a pressure reducing valve disposed in the use-side circuit to reduce a pressure of refrigerant in accordance with an opening degree of the pressure reducing valve, wherein when leakage of refrigerant in the use-side circuit is detected by the refrigerant leakage detector, the controller controls the pressure reducing valve to the closed state.

5. The refrigeration apparatus according to claim 1, further comprising:

a compressor disposed in the heat-source-side circuit to compress refrigerant;

a channel-switching valve that redirects a flow of refrigerant between the heat-source-side circuit and the use-side circuit;

a heat-source-side heat exchanger disposed in the heat-source-side circuit to function as a refrigerant heat exchanger;

a use-side heat exchanger disposed in the use-side circuit to function as a refrigerant heat exchanger; and a first valve that interrupts, when being switched to the closed state, a flow of high-pressure refrigerant between the heat-source-side circuit and the use-side circuit, wherein during normal cycle operation, the controller controls the channel-switching valve to a normal cycle state to cause the heat-source-side heat exchanger to function as a refrigerant condenser or radiator and to cause the use-side heat exchanger to function as a refrigerant evaporator, during reverse cycle operation, the controller controls the channel-switching valve to a reverse cycle state to cause the heat-source-side heat exchanger to function as a refrigerant evaporator and to cause the use-side heat exchanger to function as a refrigerant condenser or radiator, and when leakage of refrigerant in the use-side circuit is detected by the refrigerant leakage detector, the controller controls the channel-switching valve to the normal cycle state, controls the first valve to the closed state, and causes the compressor to operate.

* * * * *